US008177341B2

(12) United States Patent
Shinada et al.

(10) Patent No.: US 8,177,341 B2
(45) Date of Patent: May 15, 2012

(54) LIQUID INJECTING METHOD AND LIQUID CONTAINER

(75) Inventors: Satoshi Shinada, Shiojiri (JP); Chiaki Miyajima, Matsumoto (JP); Masahide Matsuyama, Nagano-ken (JP); Yuichi Seki, Hatsumoto (JP); Hisashi Koike, Suwa (JP); Takayoshi Katsumura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1218 days.

(21) Appl. No.: 11/836,857

(22) Filed: Aug. 10, 2007

(65) Prior Publication Data

US 2009/0015644 A1 Jan. 15, 2009

(30) Foreign Application Priority Data

Aug. 11, 2006 (JP) ..... 2006-220755
Aug. 12, 2006 (JP) ..... 2006-220767
Aug. 12, 2006 (JP) ..... 2006-220770

(51) Int. Cl.
*B41J 2/175* (2006.01)

(52) U.S. Cl. ..... 347/86

(58) Field of Classification Search ..... 347/7, 19, 347/49, 85, 86
See application file for complete search history.

(56) References Cited

U.S. PATENT DOCUMENTS 5,721,576 A * 2/1998 Barinaga ..... 347/85
5,790,157 A * 8/1998 Higuma et al. ..... 347/85
5,790,158 A 8/1998 Shinada et al.
6,036,305 A * 3/2000 Nagasaki et al. ..... 347/86
6,848,776 B2 2/2005 Nishioka et al.
6,854,835 B2 * 2/2005 Kobayashi et al. ..... 347/85
6,905,199 B2 6/2005 Miyazawa et al.
7,029,106 B2 4/2006 Nishioka et al.
7,165,835 B2 * 1/2007 Ota et al. ..... 347/86
7,252,377 B2 8/2007 Nishioka et al.

(Continued)

FOREIGN PATENT DOCUMENTS

EP 1164021 A2 12/2001

(Continued)

OTHER PUBLICATIONS

Extended European Search Report for EP 07015771 dated Feb. 24, 2009.

(Continued)

*Primary Examiner* — Anh T. N. Vo
(74) *Attorney, Agent, or Firm* — Sughrue Mion, PLLC

(57) ABSTRACT

A method of injecting a liquid into a liquid container detachably mounted on a liquid consuming apparatus, the liquid container including a liquid containing portion, a liquid supply portion connectable to a liquid ejecting portion of the liquid consuming apparatus, a liquid guide passage for guiding the liquid stored in the liquid containing portion to the liquid supply portion, an air communicating passage communicating the liquid containing chamber with air, a liquid detection unit provided in the liquid guide passage and for outputting different signals between in a case where the liquid guide passage is filled with the liquid and in a case where the liquid guide passage includes air entered thereinto, and a bubble trapping passage provided in the liquid guide passage between a detection position of the liquid detection unit and the liquid containing portion to trap bubbles in the liquid, the method includes: forming an injection port communicating with the liquid containing portion in the air communicating passage; injecting a predetermined amount of the liquid through the injection port; and sealing the injection port after injecting the liquid.

10 Claims, 16 Drawing Sheets

U.S. PATENT DOCUMENTS

| | | | | |
|---|---|---|---|---|
| 7,293,866 | B2 | 11/2007 | Miyazawa et al. | |
| 7,635,180 | B2 * | 12/2009 | Hattori et al. | 347/86 |
| 2002/0109760 | A1 | 8/2002 | Miyazawa et al. | |
| 2004/0239736 | A1 | 12/2004 | Miyazawa et al. | |
| 2005/0243110 | A1 | 11/2005 | Takahashi et al. | |
| 2006/0203053 | A1 * | 9/2006 | Katsumura | 347/86 |
| 2007/0222833 | A1 | 9/2007 | Ishizawa et al. | |
| 2007/0229629 | A1 | 10/2007 | Miyazawa et al. | |
| 2008/0012914 | A1 | 1/2008 | Ishizawa et al. | |
| 2008/0012915 | A1 | 1/2008 | Ishizawa et al. | |
| 2008/0036806 | A1 * | 2/2008 | Shinada et al. | 347/9 |
| 2008/0036808 | A1 * | 2/2008 | Shinada et al. | 347/11 |
| 2008/0036829 | A1 | 2/2008 | Nishioka et al. | |
| 2008/0094429 | A1 | 4/2008 | Miyazawa et al. | |

FOREIGN PATENT DOCUMENTS

| | | | |
|---|---|---|---|
| EP | 1 258 362 | A1 | 11/2002 |
| EP | 1258359 | A1 | 11/2002 |
| EP | 1314565 | A2 | 5/2003 |
| EP | 1380429 | A2 | 1/2004 |
| EP | 1661710 | A2 | 5/2006 |
| EP | 1 702 755 | A2 | 9/2006 |
| EP | 1757453 | A1 | 2/2007 |
| EP | 1792734 | A2 | 6/2007 |
| JP | 8-132635 | A | 5/1996 |
| JP | 2001-146019 | A | 5/2001 |
| JP | 2001-328278 | A | 11/2001 |
| JP | 2003-326731 | A | 11/2003 |
| JP | 2004167692 | A | 6/2004 |
| JP | 2004-195653 | A | 7/2004 |
| JP | 2004-203059 | A | 7/2004 |
| JP | 4407678 | B2 | 11/2009 |
| WO | 2007/122793 | A1 | 11/2007 |
| WO | 2007/122794 | A1 | 11/2007 |

OTHER PUBLICATIONS

Extended European Search Report dated Jun. 30, 2011, in counterpart European Application No. 11162208.0.

Office Action issued Jun. 7, 2011, in Vietnamese Application No. 1-2009-00274.

* cited by examiner

LIQUID INJECTING METHOD AND LIQUID CONTAINER

BACKGROUND

1. Technical Field

The present invention relates to a liquid injecting method of injecting a liquid container suitable for an ink cartridge detachably mounted on, for example, an ink jet printer and the like, and the liquid container.

2. Related Art

As the ink cartridge (liquid container) detached from or attached to a liquid consuming apparatus such as the ink jet printer, there are suggested various kinds of ink cartridges of an open-air type that include an ink containing portion (liquid containing portion) for containing ink in a container body detachably mounted in a printer, an ink supply portion (liquid supply portion) for being connected to a printing head (liquid ejecting unit) of the printer, an ink guide passage (liquid guide passage) for guiding the ink contained in the ink containing portion to the ink supply portion, an air communicating passage for introducing open air into the ink containing portion from the outside with a consumption of the ink contained in the ink containing portion.

In such an ink cartridge, an ink residual quantity detecting mechanism (liquid detecting unit) in which a sensor having a piezoelectric vibrating body is disposed at a reference height in the liquid containing portion is provided (for example, see Patent Document 1). The liquid level of the ink stored in the liquid containing portion falls to the reference height with consumption by printing and outside air introduced from the air communicating passage to the liquid containing portion according to ink consumption reaches a detection position of the sensor. Then, the ink residual quantity detection mechanism outputs different signals between when the periphery of the sensor fills with an ink liquid and when the periphery of the sensor comes in contact with the air. The printer detects that the liquid level of the ink falls to the reference height based on the signals (change in residual vibration) output from the ink residual quantity detection mechanism.

That is, a change of acoustic impedance is detected by causing a piezoelectric device having a piezoelectric element or a vibrating portion of an actuator provided in the liquid containing portion to vibrate, subsequently by measuring a counter electromotive force generated by the residual vibration remaining in the vibrating portion, and by detecting an amplitude of a resonance frequency or a counter electromotive force waveform. The detected signal is used to display the residual quantity of ink or give notice of a cartridge replacement time.

Patent Document 1: JP-A-2001-146019

However, an ink cartridge is a container that includes multiple elements and is formed with a high precision. Accordingly, when ink is exhausted, the disuse of the ink cartridge results in a waste of a useful resource and a big economical loss. It is desirable that the used ink cartridge be re-used by re-injecting ink therein.

However, when the known ink cartridge is manufactured, an ink injecting step is included. Accordingly, after the ink cartridge is manufactured, there are many cases where the same ink injecting step cannot be used. As a result, it is necessary to develop a method of injecting ink in order to realize an ink-re-filling, instead of the ink injecting method at the time a new ink cartridge is manufactured.

A recent ink cartridge becomes high performance in that a differential pressure valve that adjusts an ink pressure to be supplied to the ink supply portion and also serves as a non-return valve for preventing the ink from flowing backward from an ink supply portion or an ink residual quantity mechanism for detecting an ink residual quantity is provided in an ink guide passage allowing an ink containing chamber to communicate with the ink supply portion. Moreover, a configuration of the ink containing chamber or an air communicating passage becomes complicated.

For this reason, when a container body is arranged carelessly and when ink is injected, a poor re-use may be caused. For example, the ink may leak into portions other than the ink containing portion or an original function may be damaged due to bubbles mixed when the ink is injected. For this reason, a re-use may be impossible.

In particular, when the bubbles floating in the injected ink are stuck to the surface of a sensor of the ink residual quantity detecting mechanism, the stuck bubbles may cause a change in residual vibration. Accordingly, it is not accurately detected whether there is the ink, and thus it may be erroneously detected that the liquid level of the ink falls.

SUMMARY

An advantage of some aspects of the invention is to provide a liquid injecting method of injecting a liquid into a liquid container into which the liquid can be injected without damage to a primary function of the liquid container, and the liquid container. The advantage can be attained by at least one of the following aspects:

A first aspect of the invention provides a method of injecting a liquid into a liquid container detachably mounted on a liquid consuming apparatus, the liquid container comprising a liquid containing portion, a liquid supply portion connectable to a liquid ejecting portion of the liquid consuming apparatus, a liquid guide passage for guiding the liquid stored in the liquid containing portion to the liquid supply portion, an air communicating passage communicating the liquid containing chamber with air, a liquid detection unit provided in the liquid guide passage and for outputting different signals between in a case where the liquid guide passage is filled with the liquid and in a case where the liquid guide passage includes air entered thereinto, and a bubble trapping passage provided in the liquid guide passage between a detection position of the liquid detection unit and the liquid containing portion to trap bubbles in the liquid, the method comprising: forming an injection port communicating with the liquid containing portion in the air communicating passage; injecting a predetermined amount of the liquid through the injection port; and sealing the injection port after injecting the liquid.

According to the method of injecting the liquid with the above-described configuration, the steps carried out for the container body include steps of opening the injection port in order to inject the liquid, injecting the liquid, and sealing the injection port, which are all the simple steps. When injecting the liquid into the used liquid container, the container body is only a little processed and thus the liquid can be injected without damaging the original function of the liquid container. As a result, the used liquid container can be used at a low price.

In the method of injecting the liquid with the above-described configuration, the method may further comprise depressurizing an inside of the liquid containing chamber before injecting the liquid.

According to the method of injecting the liquid, since the inside of the liquid containing chamber is depressurized in the depressurization process, the liquid can be effectively injected into the ink containing chamber in the subsequent ink injecting process.

In the method of injecting the liquid with the above-described configuration, the inside of the liquid containing chamber may be depressurized through the liquid supply portion.

According to the method of injecting the liquid, specifically, when the liquid container is provided with a differential valve, the liquid can be injected up to a downstream of the differential valve.

In the method of injecting the liquid with the above-described configuration, the injection port may be formed in a downstream end of the air communicating path.

A second aspect of the invention provides a liquid container detachably mounted on a liquid consuming apparatus, the liquid container comprising: a liquid containing portion; a liquid supply portion connectable to a liquid ejecting portion of the liquid consuming apparatus, a liquid guide passage for guiding the liquid stored in the liquid containing portion to the liquid supply portion; an air communicating passage communicating the liquid containing chamber with air; a liquid detection unit provided in the liquid guide passage and for outputting different signals between in a case where the liquid guide passage is filled with the liquid and in a case where the liquid guide passage includes air entered thereinto; and a bubble trapping passage provided in the liquid guide passage between a detection position of the liquid detection unit and the liquid containing portion to trap bubbles in the liquid, wherein an injection port communicating with the liquid containing portion is formed in the air communicating passage, a predetermined amount of liquid is injected through the injection port, and the injection port is sealed after the liquid is injected.

According to the liquid container with the above-described configuration, when the ink passes through the bubble trapping passage provided in the more upstream side than a detection position of the liquid detection unit in the liquid guide passage, the liquid filled in the bubble trapping passage induces buoyancy acting against the inflow to the downstream side to act on the bubble floating in the ink that flows into the liquid guide passage from the liquid containing portion to the liquid supply portion. For this reason, the bubble does not flow to the liquid detection unit. Accordingly, the bubble in the liquid of the liquid containing portion is not stuck to the liquid detection unit provided in the vicinity of the liquid supply portion. Before the end of liquid (boundary of a gas and a liquid) flowing to the liquid supply portion passes through the liquid detection unit, the liquid detection unit does not cause a erroneous detection that the amount of the residual ink of the liquid containing portion is zero or is lowered to a predetermined amount. As a result, the liquid detection unit can cause an exact detection that the amount of the residual ink of the liquid containing portion is zero or is lowered to a predetermined amount.

In the liquid container according to the above-described configuration, the bubble trapping passage may have a vertical changing portion for changing a flow direction of a liquid to a vertical direction.

According to the liquid container with the above-described configuration, the vertical changing portion for changing the flow direction to a vertical direction separates the bubbles from the liquid. In this way, since the liquid flowing to the liquid supply portion goes through the bubble-tapping process until the ink reaches the liquid detection unit. Accordingly, the bubble mixed in the liquid is removed.

In the liquid container according to the above-described configuration, the bubble trapping passage may have a horizontal changing portion for changing a flow direction of the liquid to a horizontal direction.

According to the liquid container with the above-described configuration, the horizontal changing portion for changing the flow direction of the liquid to a horizontal direction separates the bubble mixed in the liquid. In this way, since the liquid flowing to the liquid supply portion goes through the bubble-tapping process until the ink reaches the liquid detection unit. Accordingly, the bubble mixed in the liquid is removed. In addition, by properly combining the number of the vertical changing portions and the horizontal changing portions, the liquid flowing to the liquid supply portion goes through the repeated bubble-trapping process in the vertical changing portions and the horizontal changing portions. Accordingly, the bubble is more reliably removed.

In the liquid container according to the above-described configuration, the bubble trapping passage may have a bubble trapping space in which a section of the passage extends vertically upward more than the front and rear positions of the passage.

According to the liquid container with the above-described configuration, the bubble floating in the liquid can be stored in the bubble trapping space in which the section of the passage extends vertically upward and a large amount of the bubbles can be stored in the bubble trapping space. In addition, since the front and rear positions of the flow passage is below the bubble trapping space, the liquid filled in the bubble trapping space induces buoyancy acting against the flow passage positioned below to act on the air stored in the bubble trapping space. For this reason, even when the liquid container separated from an apparatus during the usage is affected by strong vibration or impact due to the falling or the like, it is difficult for the air stored in the bubble trapping space to leak out of the bubble trapping space. Further, a large amount of the bubbles can be stored in one bubble trapping space.

In the liquid container according to the above-described configuration, the bubble trapping passage may have a bubble trapping space at the end thereof in a horizontal direction.

According to the liquid container with the above-described configuration, a bubble trapping space positioned at the end portion that is out of the flow passage of the liquid supply portion stores the bubbles floating in the liquid, and thus can collect a large amount of the bubbles.

In the liquid container according to the above-described configuration, a porous member for trapping the bubbles may be provided in the bubble trapping passage or on the more upstream side in the liquid guide passage than the detection position of the liquid detection unit.

According to the liquid container with the above-described configuration, since the porous member provided in the flow passage effectively traps the bubble mixed in the liquid, it can be improved that the bubbles are trapped efficiently and reliably.

In the liquid container according to the above-described configuration, a liquid supply port of the liquid containing portion connected to the liquid guide passage or the bubble trapping passage may be formed in a circular-section passage with a 2 mm or less diameter.

According to the liquid container with the above-described configuration, the liquid outlet port of the liquid containing portion has the 2 mm or less circular-section passage. Since the liquid supply port causes a surface tension of meniscus preventing the bubble from flowing out, the bubble can be prevented from flowing out from the liquid containing portion to the liquid detection unit.

Accordingly, a burden of the bubble trapping passage is reduced, and thus preventing the bubble from sticking to the liquid detection unit can be improved.

In the liquid container according to the above-described configuration, a passage constituting the bubble trapping passage may have a rectangular section.

According to the liquid container with the above-described configuration, the sectional surface of the passage is rectangular in shape. Accordingly, an unnecessary space between the parallel flow passages exists less than the flow passage with the circular-section passage, and thus the highly complex flow passages can be formed. Even when the bubble trapping passage is formed by means of resin molding, moldability is improved In addition, when the section of the passage is rectangular in shape, compared to the circular section of the passage, sluggish areas in which the ink slowly flows at corners of the rectangular section of the passage are formed. Since the upper corners in the passage section also serve as the bubble trapping space in which the bubbles separated in the flow changing portions are stored, the bubble B is captured or trapped in the upper corners.

In the liquid container according to the above-described configuration, the liquid container may comprise a differential pressure valve which is disposed in the liquid guide passage, which is normally urged to be a closed state, and which is changed from the closed state to an opened state when a differential pressure between a side of the liquid supply portion and a side of the liquid containing portion is equal to or more than a predetermined amount.

A third aspect of the invention provides a liquid container detachably mounted on a liquid consuming device includes: a liquid containing portion; a liquid supply portion connectable to the liquid consuming device; a liquid guide passage communicating the liquid containing portion and the liquid supply portion with each other; an air communicating path communicating the liquid containing portion with air; a liquid detection unit provided in the liquid guide passage and for outputting different signals between in a case where the liquid guide passage is filled with the liquid and in a case where the liquid guide passage includes air entered thereinto; a bubble trapping passage provided in the liquid guide passage between a detection position of the liquid detection unit and the liquid containing portion to trap bubbles in the liquid; a film member forming at least a part of the air communication path; and a sealing portion at which an injection port communicated with the liquid containing portion and formed on the film member is sealed.

According to the liquid container with the above-described configuration, when the ink passes through the bubble trapping passage provided in the more upstream side than a detection position of the liquid detection unit in the liquid guide passage, the liquid filled in the bubble trapping passage induces buoyancy acting against the inflow to the downstream side to act on the bubble floating in the ink that flows into the liquid guide passage from the liquid containing portion to the liquid supply portion. For this reason, the bubble does not flow to the liquid detection unit. Accordingly, the bubble in the liquid of the liquid containing portion is not stuck to the liquid detection unit provided in the vicinity of the liquid supply portion. Before the end of liquid (boundary of a gas and a liquid) flowing to the liquid supply portion passes through the liquid detection unit, the liquid detection unit does not cause the erroneous detection that the amount of the residual ink of the liquid containing portion is zero or is lowered to a predetermined amount. As a result, the liquid detection unit can cause the exact detection that the amount of the residual ink of the liquid containing portion is zero or is lowered to a predetermined amount.

In addition, the leakage of the liquid through the injection port can be surely prevented by the sealing portion, which is formed by sealing the injection port.

In the liquid container according to the above-described configuration, the sealing portion may be formed by a film or a tape.

According to the liquid container with the above-described configuration, the sealing portion, which is formed by sealing the injection port, can be easily and surely formed.

BRIEF DESCRIPTION OF THE DRAWINGS

The invention will be described with reference to the accompanying drawings, wherein like numbers reference like elements.

FIG. 10(*b*) is a schematic diagram of the FIG. 9.

DESCRIPTION OF EXEMPLARY EMBODIMENTS

Hereinafter, a liquid injecting method and a liquid container according to an exemplary embodiment of the invention will be described in detail with reference to drawings. In the exemplary embodiment described below, as an exemplified liquid container, an ink cartridge mounted on an ink jet printing apparatus (printer), which is an example of a liquid ejecting apparatus, will be described.

Figure 1:
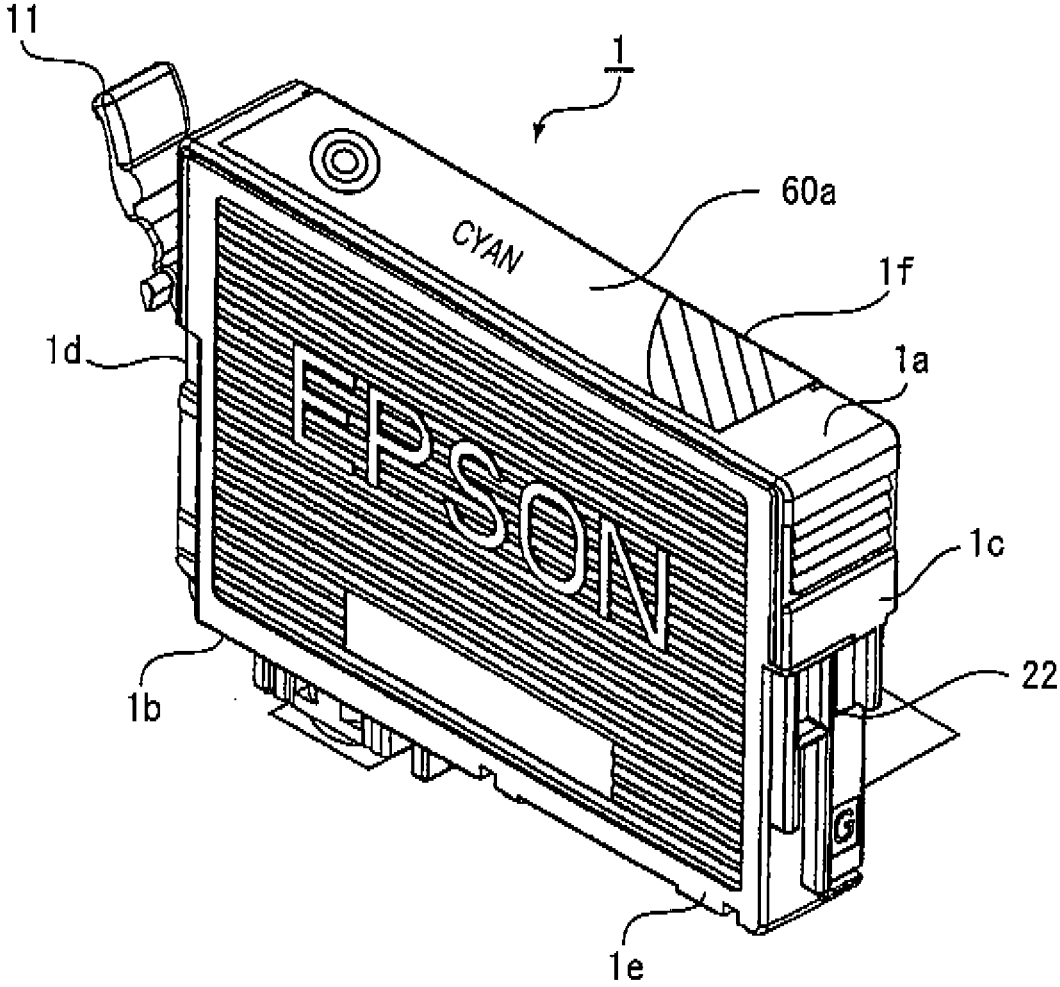
FIG. 1 is an exterior perspective view illustrating an ink cartridge which is an example of the liquid container according to an exemplary embodiment of the invention.
Figure 2:
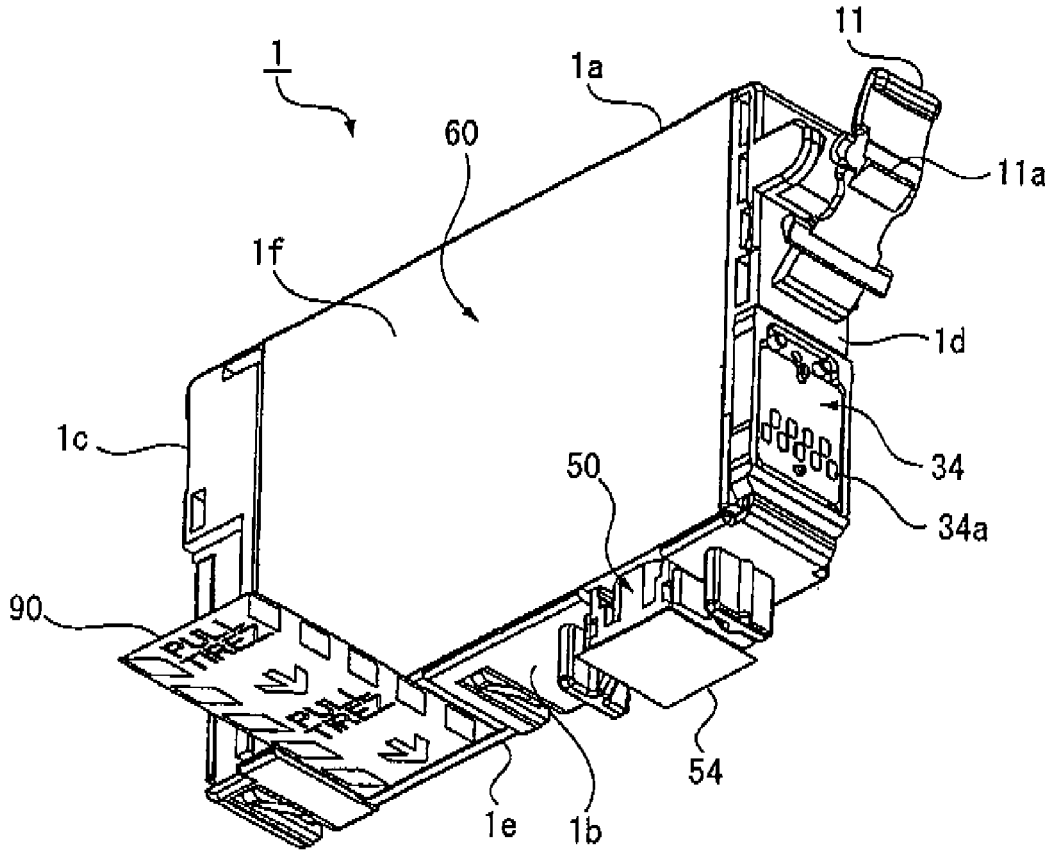
FIG. 2 is an exterior perspective view illustrating the ink cartridge according to the exemplary embodiment of the invention when viewed from the opposite side thereof in FIG. 1.
Figure 3:
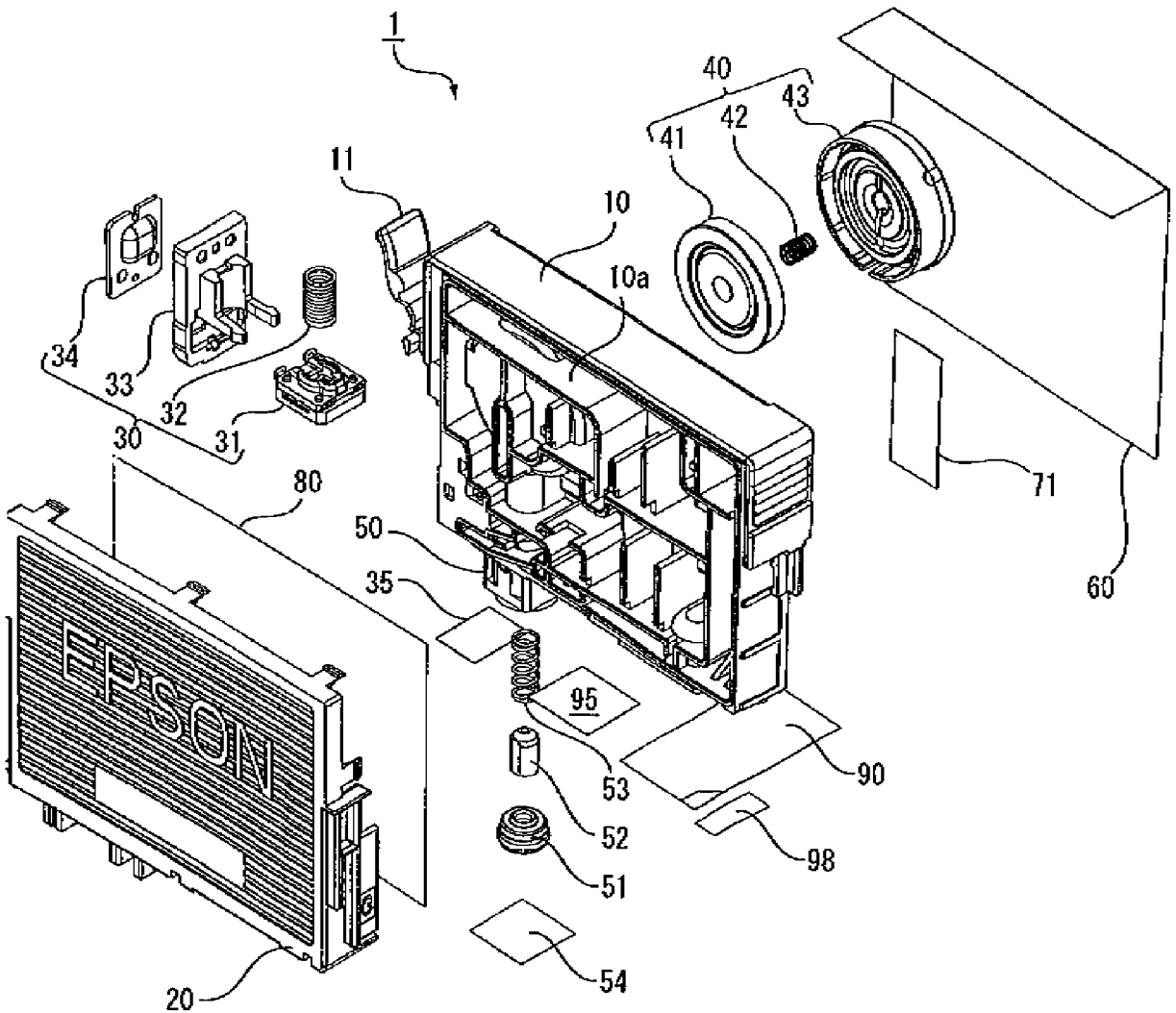
FIG. 3 is an exploded perspective view illustrating the ink cartridge according to the exemplary embodiment of the invention.
Figure 4:
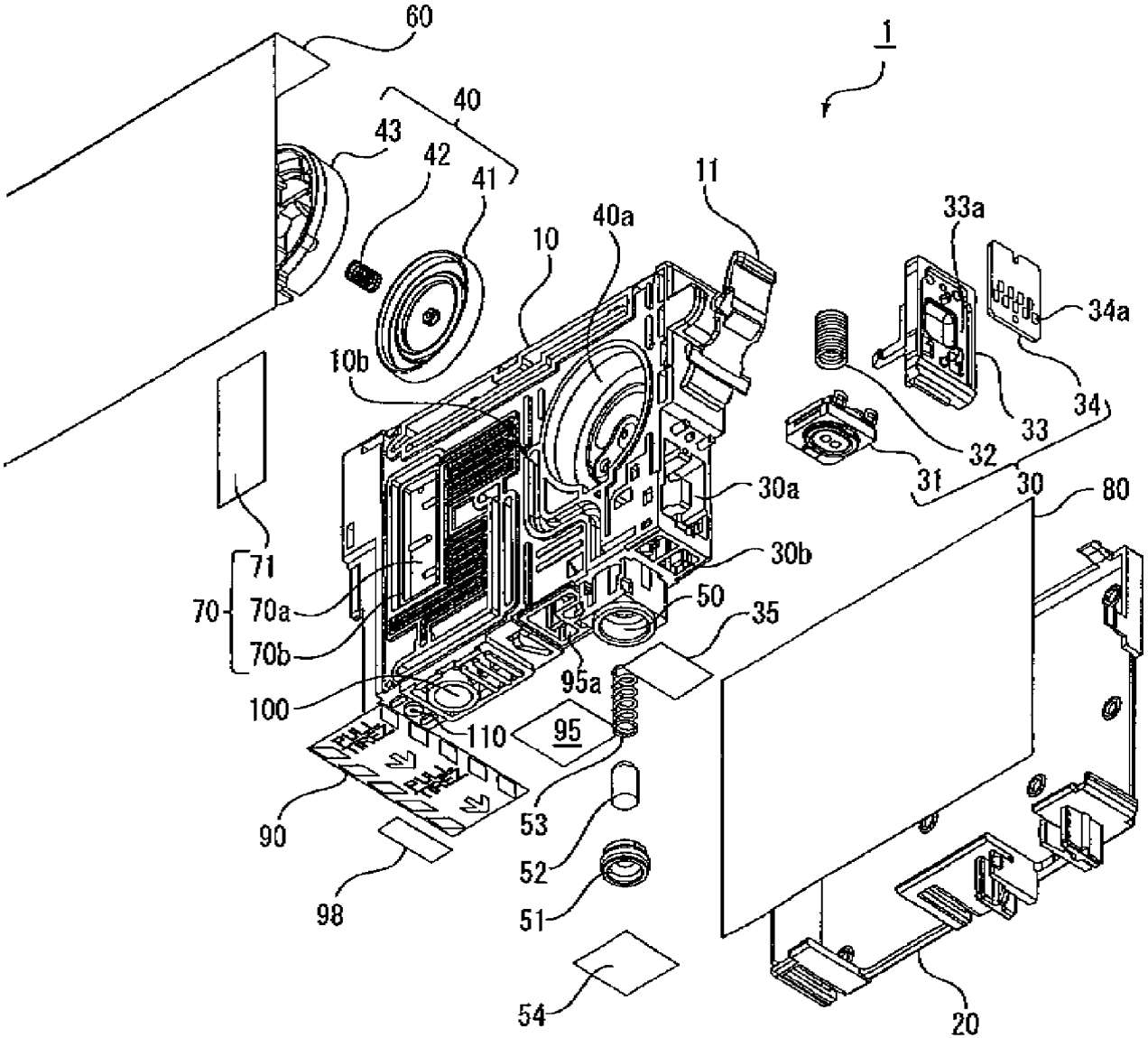
FIG. 4 is an exploded perspective view illustrating the ink cartridge according to the exemplary embodiment of the invention when viewed from the opposite side thereof in FIG. 3.
Figure 5:
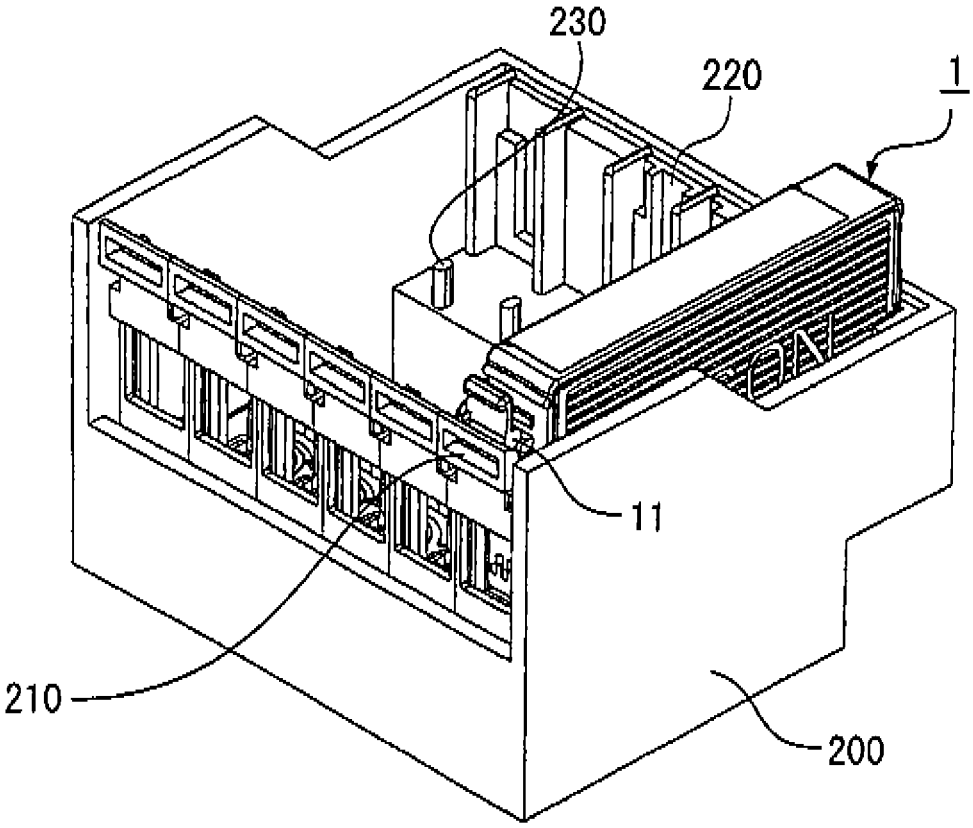
FIG. 5 is a view illustrating when the ink cartridge according to the exemplary embodiment of the invention is mounted on a carriage.
Figure 6:
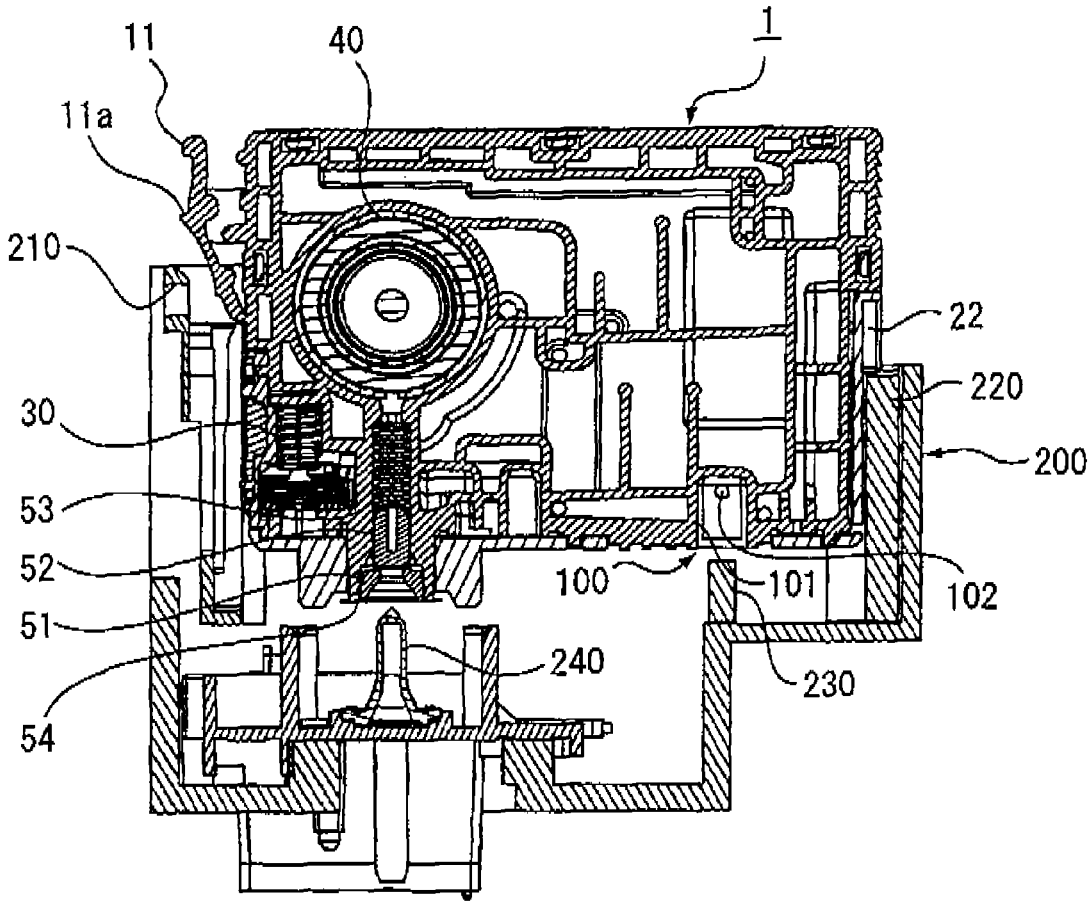
FIG. 6 is a sectional view illustrating the ink cartridge according to the exemplary embodiment of the invention immediately before the ink cartridge is mounted on the carriage.
Figure 7:
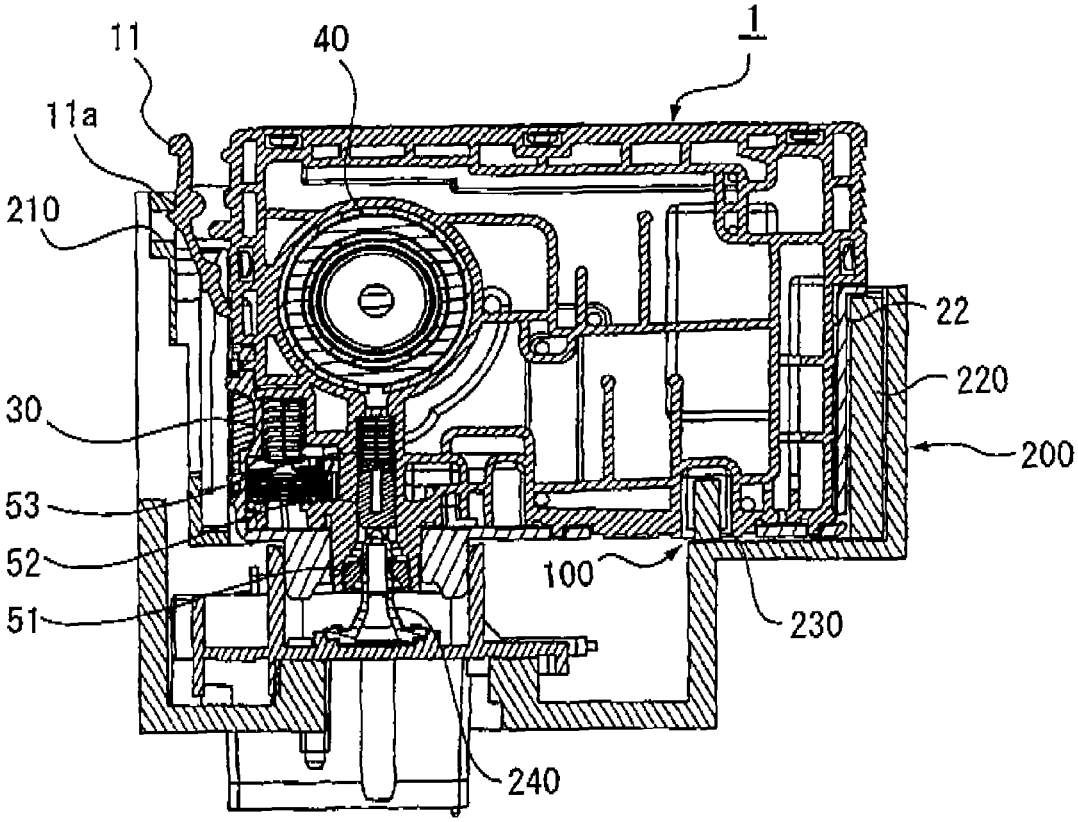
FIG. 7 is a sectional view illustrating the ink cartridge according to the exemplary embodiment of the invention immediately after the ink cartridge is mounted on the carriage.

FIG. 1 is an exterior perspective view illustrating the ink cartridge that is an example of the liquid container according to an exemplary embodiment of the invention. FIG. 2 is an exterior perspective view illustrating the ink cartridge according to the exemplary embodiment when viewed from the opposite side thereof in FIG. 1. FIG. 3 is an exploded perspective view illustrating the ink cartridge according to the exemplary embodiment. FIG. 4 is an exploded perspective view illustrating the ink cartridge according to the exemplary embodiment when viewed from the opposite side thereof in FIG. 3. FIG. 5 is a view illustrating when the ink cartridge according to the exemplary embodiment is mounted on a carriage. FIG. 6 is a sectional view illustrating the ink cartridge immediately before the ink cartridge is mounted on the carriage. FIG. 7 is a sectional view illustrating the ink cartridge immediately after the ink cartridge is mounted on the carriage.

As shown in FIGS. 1 and 2, an ink cartridge 1 according to the exemplary embodiment has a substantially rectangular parallelepiped shape and is the liquid container for storing/containing ink (liquid) I in an ink containing chamber (liquid containing portion) that is provided therein. The ink cartridge 1 is mounted on a carriage 200 of an ink jet printing apparatus, which is an example of a liquid consuming device, so as to supply the ink to the inkjet printing apparatus (see FIG. 5).

An exterior appearance of the ink cartridge 1 will be described. As shown in FIGS. 1 and 2, the ink cartridge 1 has a flat upper surface 1*a*, and an ink supply portion (liquid supply portion) 50 that is connected to the ink jet printing apparatus to supply the ink is provided on a bottom surface 1*b* that is opposed to the upper surface 1*a*. Further, an air introducing hole 100 that communicates with the inside of the cartridge 1 for introducing air into the ink cartridge 1 is opened in the bottom surface 1*b*. That is, the ink cartridge 1 is an ink cartridge of an open-air type that provides the ink from the ink supply portion 50 while introducing air from the air introducing hole 100.

In the exemplary embodiment, the air introducing hole 100, as shown in FIG. 6, has a substantially cylindrical concave portion 101 that opens from the bottom surface toward the upper surface in the bottom surface 1*b* and a small hole 102 that opens in the inner circumference surface of the concave portion 101. Since the small hole 102 communicates with an air communicating passage described below, the air is introduced into an upper ink containing chamber 370 (described below) positioned on an uppermost stream through the small hole 102.

The concave portion 101 of the air introducing hole 100 is formed in a position in which a protrusion 230 formed in the carriage 200 can be inserted. The protrusion 230 serves as a non-removing prevention protrusion for preventing removal of a sealing film 90 that is means for air-tightly blocking the air introducing hole 100. That is, when the sealing film 90 is attached to the air introducing hole 100, the protrusion 230 cannot be inserted into the air introducing hole 100, and thus the ink cartridge 1 is not mounted on the carriage 200. Accordingly, even when a user tries to mount the ink cartridge 1 on the carriage 200 with the sealing film 90 attached to the air introducing hole 100, the ink cartridge 1 cannot be mounted. As a result, when the ink cartridge 1 is mounted, it can be urged to certainly remove the sealing film 90.

As shown in FIG. 1, an erroneous inserting prevention protrusion 22 for preventing the ink cartridge 1 from being mounted on an erroneous position is formed on a narrow surface 1*c* adjacent to one end side of the upper surface 1*a* of the ink cartridge 1. As shown in FIG. 5, an uneven portion 220 corresponding to the erroneous inserting prevention protrusion 22 is formed on the carriage 200 which serves as a receiver. The ink cartridge 1 is mounted on the carriage 200 only when the erroneous inserting prevention protrusion 22 and the uneven portion 220 are not interfered with each other. The erroneous inserting prevention protrusion 22 has a different shape according to each kind of ink, and thus the uneven portion 220 on the carriage 200 which serves as the receiver has also a different shape according to the corresponding kind of ink. As a result, even when the plurality of ink cartridges is mounted on the carriage 200, as shown in FIG. 5, the ink cartridges may not be mounted on erroneous positions.

As shown in FIG. 2, an engagement lever 11 is provided on a narrow surface 1*d* that is opposite to the narrow surface 1*c* of the ink cartridge 1. A protrusion 11*a* that is engaged with a concave portion 210 formed in the carriage 200 when the ink cartridge 1 is mounted to the carriage 200 is formed in the engagement lever 11. Moreover, the protrusion 11*a* and the concave portion 210 are engaged with each other while the engagement lever 11 is bent so that the ink cartridge 1 is fixed on the carriage 200.

A circuit board 34 is provided below the engagement lever 11. A plurality of electrode terminals 34*a* are formed on the circuit board 34. Since the electrode terminals 34*a* comes in contact with an electrode member (not shown) provided in the carriage 200, the ink cartridge 1 is electrically connected with the ink jet printing apparatus. A nonvolatile memory capable of rewriting data is provided in the circuit board 34. Various data about the ink cartridge 1, ink use data of the ink jet printing apparatus, or the like are memorized in the nonvolatile memory. An ink residual quantity sensor 31 (liquid detection unit) that outputs different signals depending on an mount of residual ink in the ink cartridge 1 is provided in the back of the circuit board 34 (see FIG. 3 or 4). Hereinafter, the ink residual quantity sensor 31 and the circuit board 34 are called an ink end sensor 30.

As shown in FIG. 1, a label 60*a* for denoting a content of an ink cartridge is attached to the upper surface 1*a* of the ink cartridge 1. The edge of an outer surface film 60 that covers a wide surface 1*f* is extended and attached to the upper surface 1*a* so that the label 60*a* is formed.

As shown in FIGS. 1 and 2, the wide surfaces 1*e* and 1*f* adjacent two long sides of the upper surface 1*a* of the ink cartridge 1 are formed in a flat surface shape. Hereinafter, a side of the wide surface 1*e*, a side of the wide surface 1*f*, a side of the narrow surface 1*c*, and a side of the narrow surface 1*d* denote a front surface, a rear surface, a right surface, and a left surface, respectively for convenience' sake.

Next, each portion constituting the ink cartridge 1 will be described with reference to FIGS. 3 and 4.

The ink cartridge 1 has a cartridge body 10 that is the container body and a cover member 20 for covering the front surface of the cartridge body 10.

Ribs 10*a* that have various shapes are formed in the front surface of the cartridge body 10. The ribs 10*a* that serve as walls are formed to partition a plurality of the ink containing chambers (liquid containing portion) that fill with the ink I, a non-containing chamber which does not fill with the ink I, an air chamber that is positioned in the air communicating passage 150 described below, and so on in the inside of the cartridge body 10.

A film 80 that covers the front surface of the cartridge body 10 is provided between the cartridge body 10 and the cover member 20. The film 80 covers the upper surfaces of the ribs, concave portions, and grooves so that a plurality of flow passages, the ink containing chambers, the non-containing chamber, and the air chamber are formed.

In the rear surface of the cartridge body 10, a concave-shaped differential pressure valve accommodating chamber 40*a* configured as a concave portion for accommodating a differential pressure valve 40 and a concave-shaped gas-liquid separating chamber 70*a* configured as a concave portion for constituting a gas-liquid separating filter 70 are formed.

A valve member 41, a spring 42, and a spring seat 43 are accommodated in the differential pressure valve accommodating chamber 40*a* and constitute the differential pressure valve 40. The differential pressure valve 40 is disposed between the ink supply portion 50 positioned on the downstream and the ink containing chamber positioned on the upstream, and is urged to a closed state in which the ink flow from a side of the ink containing chamber to a side of the ink supply portion 50 is blocked. The differential pressure valve 40 is configured so that when a differential pressure between the side of the ink containing chamber and the side of the ink supply portion 50 becomes a predetermined amount or more depending on ink supply from the ink supply portion 50 to the printer, the differential valve 40 is changed from the closed state to the opened state and the ink I is supplied to the ink supply portion 50.

On the upper surface of the gas-liquid separating chamber 70*a*, a gas-liquid separating film 71 is attached along a bank 70*b* surrounding an outer circumference provided in the vicinity of the middle portion of the gas-liquid separating chamber 70*a*. The gas-liquid separating film 71 is made of a material that passes a gas, but does not pass a liquid. The gas-liquid separating film 71 constitutes the gas-liquid separating filter 70. The gas-liquid separating filter 70 is provided within the air communicating passage 150 that connects the air introducing hole 100 to the ink containing chamber, and allows the ink I in the ink containing chamber not to leak to the air introducing hole 100 through the air communicating passage 150.

In the rear surface of the cartridge body 10, a plurality of grooves 10*b* are carved in addition to the differential pressure accommodating chamber 40*a* and the gas-liquid separating chamber 70*a*. Since the outer surface film 60 covers the outer surface in a state where the differential pressure valve 40 and the gas-liquid separating filter 70 are formed, the opening of each groove 10*b* is blocked, and thus the air communicating passage 150 or the ink guide passage (liquid guide passage) is formed.

As shown in FIG. 4, a concave-shaped sensor chamber 30*a* that is configured as a concave portion for accommodating each member constituting the ink end sensor 30 is formed in the right surface of the cartridge body 10. The ink residual quantity sensor 31 and a compressing spring 32 for tightly pressing the ink residual quantity sensor 31 against the inner wall of the sensor chamber 30*a* are accommodated in the sensor chamber 30*a*. The opening of the sensor chamber 30*a* is covered with a cover member 33 so that the circuit board 34 is fixed on an outer surface 33*a* of the cover member 33. A sensing member of the ink residual quantity sensor 31 is connected to the circuit board 34.

The ink residual quantity sensor 31 includes a cavity forming a part of the ink guide passage between the ink containing chamber and the ink supply portion 50, a vibrating plate forming a part of the wall surface of the cavity, and a piezoelectric element (piezoelectric actuator) allowing vibration to be applied onto the vibrating plate. The ink residual quantity sensor 31 outputs residual vibration at the time of applying the vibrations to the vibrating plate as signals. A liquid residual quantity detector of the ink jet printing apparatus detects a difference in an amplitude, a frequency, or the like of the residual vibration between the ink I and the gas (bubble B mixed in the ink) from the signal given from the ink residual quantity sensor 31 to detect whether the ink I exists in the cartridge body 10.

Specifically, the ink I in the ink containing chamber of the cartridge body 10 is exhausted or decreased to a predetermined amount, and then air introduced into the ink containing chamber enters the inside of the cavity of the ink residual quantity sensor 31 through the ink guide passage. At this time, from a change in the amplitude or the frequency of the residual vibration based on the signal output from the ink residual quantity sensor 31, the liquid residual quantity detector of the ink jet printing apparatus detects that the ink I in the ink containing chamber of the cartridge body 10 is exhausted or decreased to the predetermined amount. Then, the liquid residual quantity detector outputs an electrical signal indicating that the ink is exhausted or nearly exhausted.

As shown in FIG. 4, a depressurization hole 110 used to depressurize the ink cartridge 1 by sucking up air from the inside thereof by vacuuming means when the ink is injected, a concave portion 95*a* constituting the ink guide passage from the ink containing chamber to the ink supply portion 50, and a buffer chamber 30*b* provided below the ink end sensor 30 are provided on the bottom surface of the cartridge body 10 in addition to the ink supply portion 50 and the air introducing hole 100 described above.

Immediately after the ink cartridge is manufactured, openings of the ink supply portion 50, the air introducing hole 100, the depressurization hole 110, the concave portion 95*a*, and the buffer chamber 30*b* are sealed by sealing films 54, 90, 98, 95, and 35, respectively. The sealing film 90 for sealing the air introducing hole 100 is removed by a user before the ink cartridge is mounted on the ink jet printing apparatus to be used. Accordingly, the air introducing hole 100 is exposed to the outside so that the ink containing chamber in the ink cartridge 1 is allowed to communicate with open air through the air communicating passage 150.

The sealing film 54 attached onto the outer surface of the ink supply portion 50, as shown in FIGS. 6 and 7, is configured so as to be torn by an ink supply needle 240 of the ink jet printing apparatus when mounted on the ink jet printing apparatus.

As shown in FIGS. 6 and 7, a ring-shaped sealing member 51 that is pressed against the outer surface of the ink supply needle 240 when mounted on a printer, a spring seat 52 that comes in contact with the sealing member 51 to block the ink supply portion 50 when not mounted on the printer, and a compressing spring 53 that urges the spring seat 52 in a direction of a contact with the sealing member 51 are included within the ink supply portion 50.

As shown in FIGS. 6 and 7, the ink supply needle 240 is inserted into the ink supply portion 50. At this time, the inner circumference of the sealing ember 51 and the outer circumference of the ink supply needle 240 are sealed with each other, and thus a gap between the ink supply portion 50 and the ink supply needle 240 is sealed liquid-tightly. In addition, the front end of the ink supply needle 51 comes in contact with the spring seat 52 to push up the spring seat 52. At this time, since the spring seat 52 and the sealing member 51 are released from each other, the ink can be supplied from the ink supply portion 50 to the ink supply needle 240.

Next, the inner configuration of the ink cartridge 1 according to the exemplary embodiment will be described with reference to the FIGS. 8 to 12.

Figure 8:
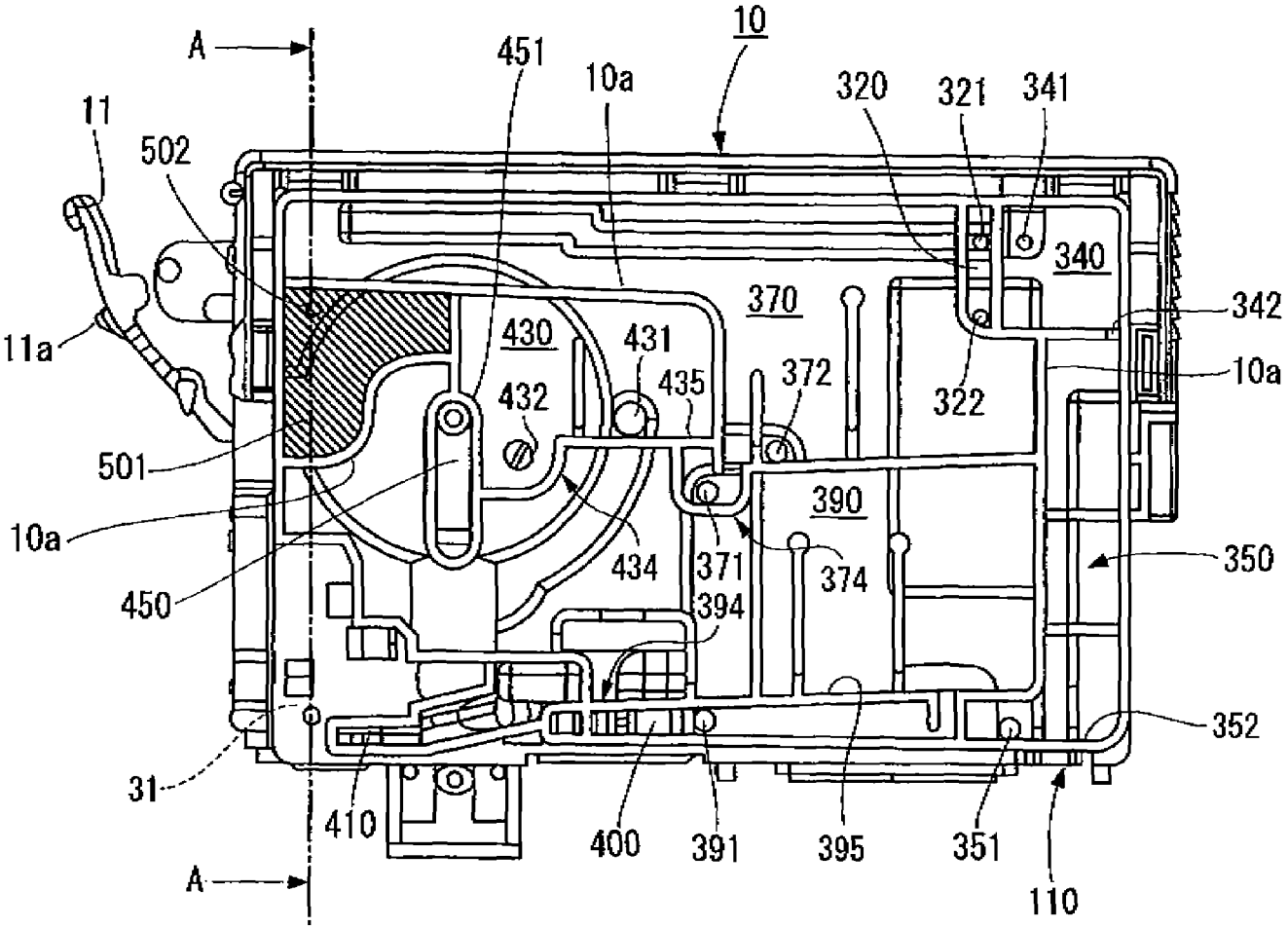
FIG. 8 is a diagram viewed from the front surface of the cartridge body of the ink cartridge according to the exemplary embodiment of the invention.
Figure 9:
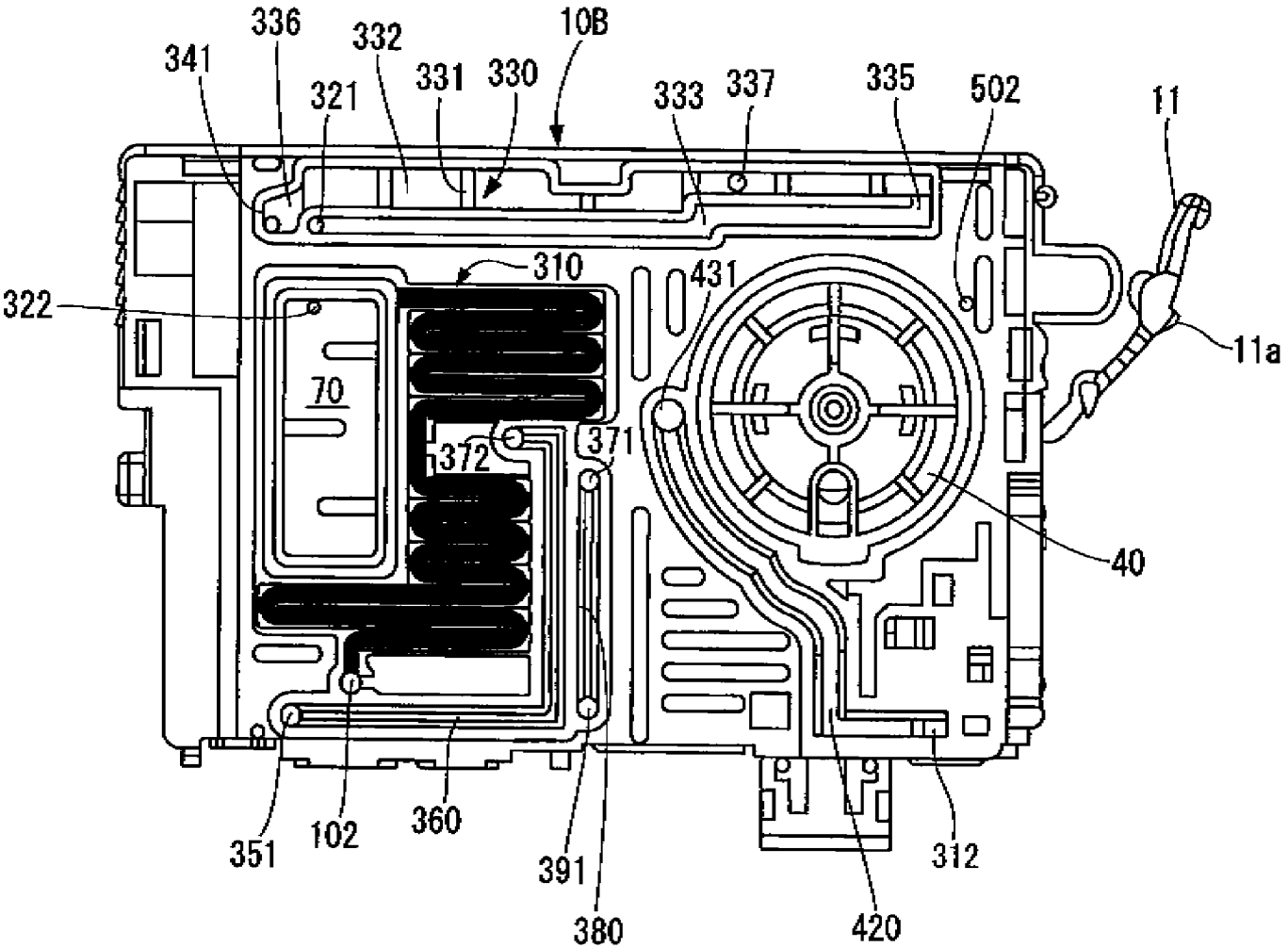
FIG. 9 is a diagram viewed from the rear surface of the cartridge body of the ink cartridge according to the exemplary embodiment of the invention.
Figure 10:
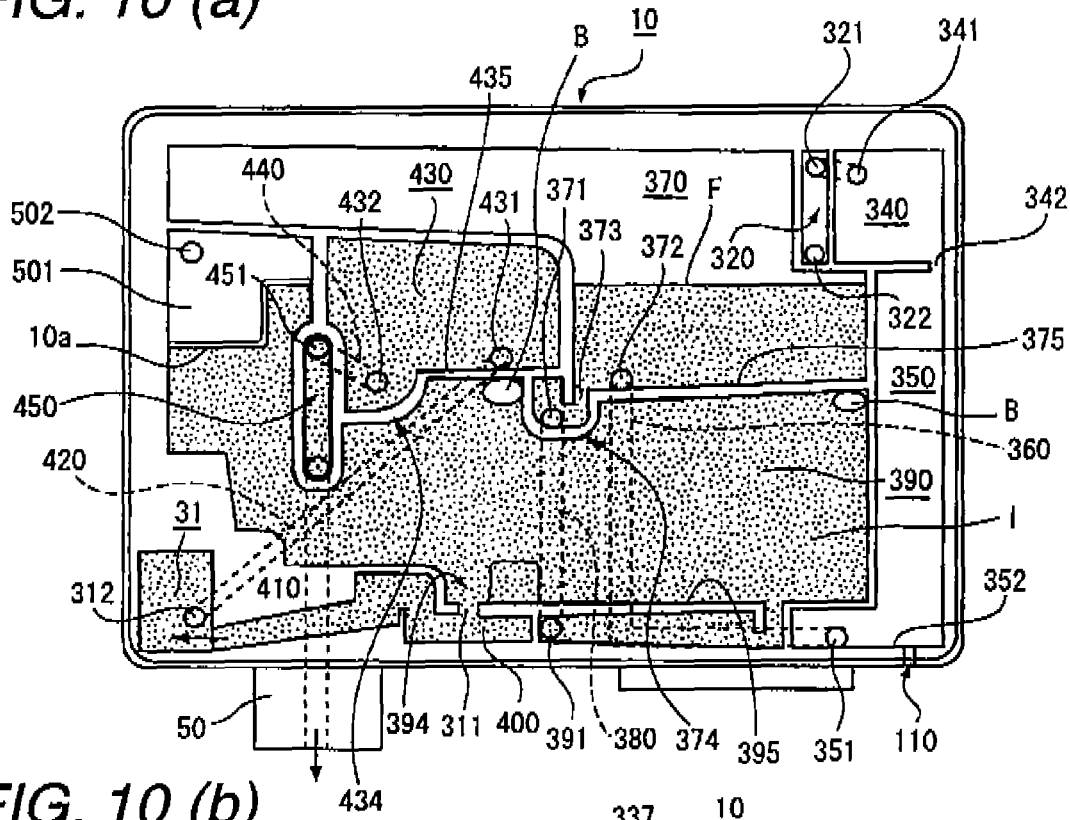
FIG. 10(*a*) is a schematic diagram of the FIG. 8.
Figure 10:
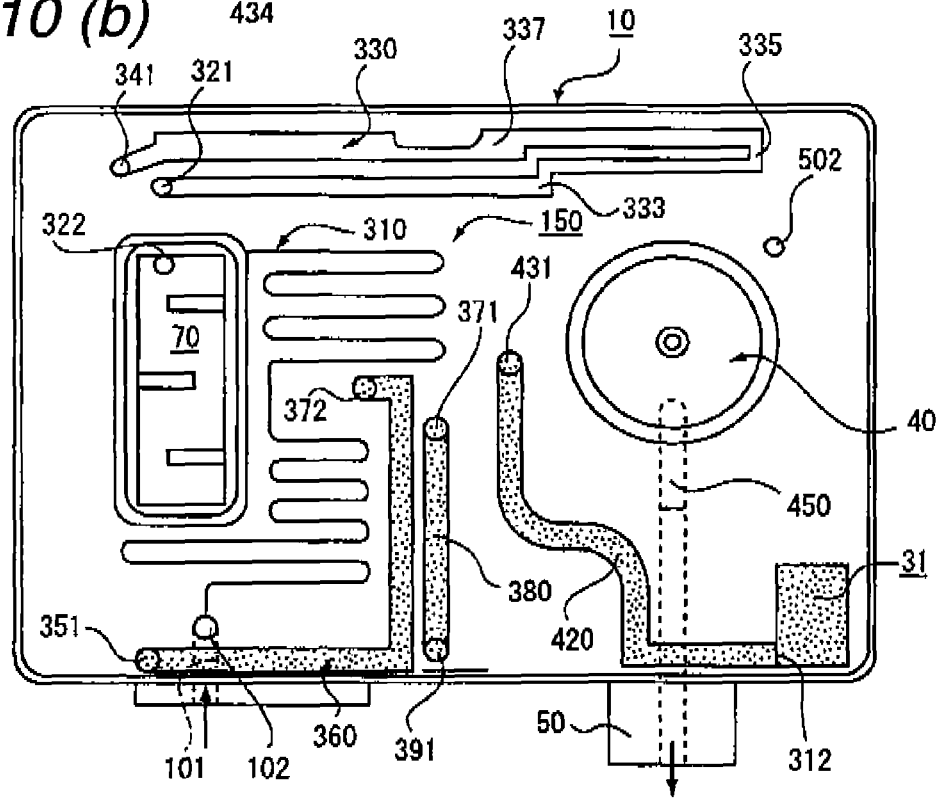
Figure 11:
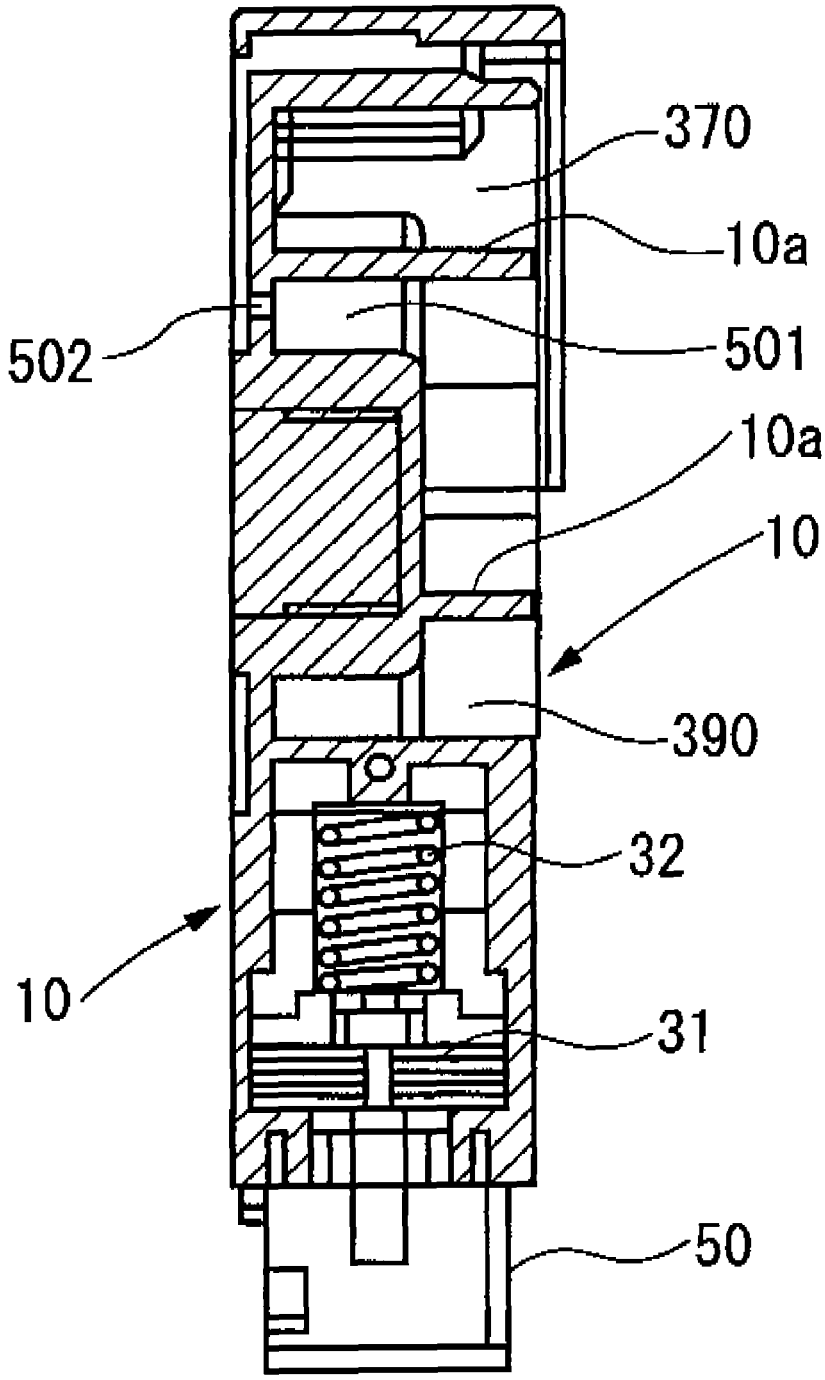
FIG. 11 is a sectional view taken along the line A-A of FIG. 8.
Figure 12:
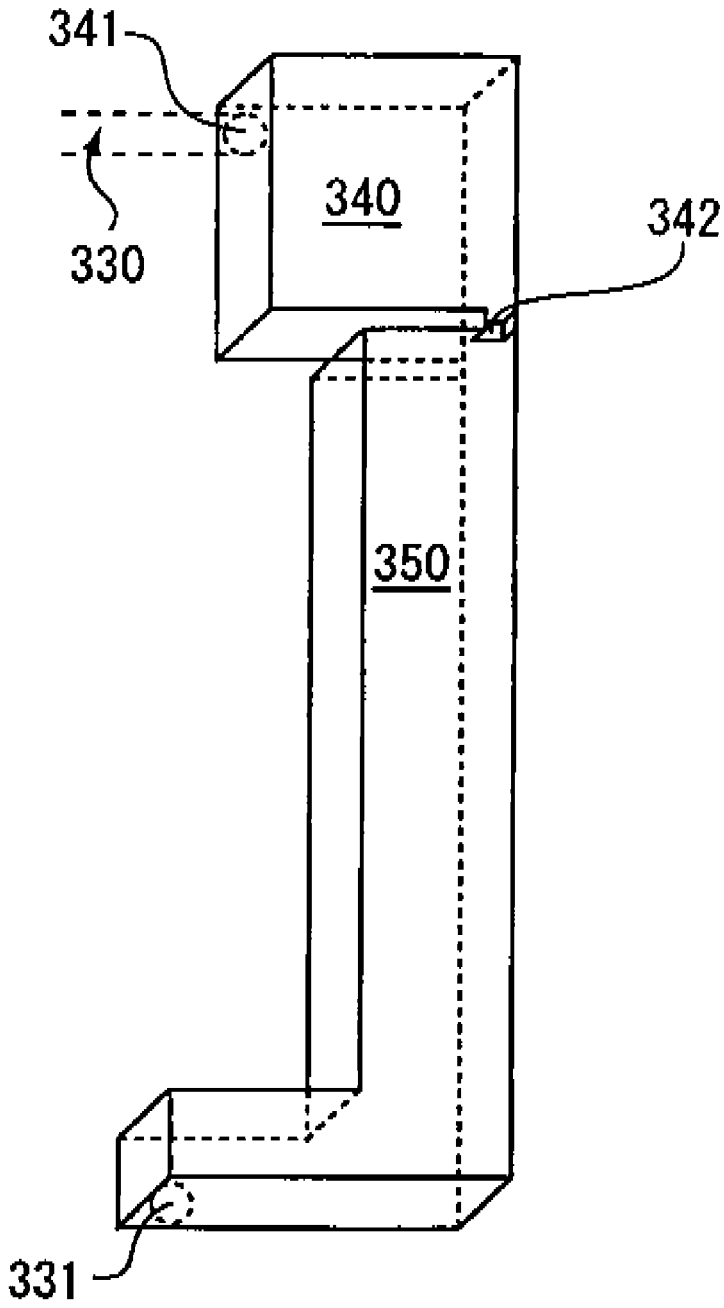
FIG. 12 is a partially enlarged perspective view illustrating a configuration of flow passages shown in FIG. 8.

FIG. 8 is a diagram viewed from the front surface of the cartridge body 10 of the ink cartridge 1 according to the exemplary embodiment. FIG. 9 is a diagram viewed from the rear surface of the cartridge body 10 of the ink cartridge 1 according to the exemplary embodiment. FIG. 10(*a*) is a schematic diagram of the FIG. 8 and FIG. 10(*b*) is a schematic diagram of the FIG. 9. FIG. 11 is a sectional view taken along the line A-A of FIG. 8. FIG. 12 is a partially enlarged perspective view illustrating a flow passage shown in FIG. 8.

In the ink cartridge 1 according to the exemplary embodiment, three ink containing chambers, that is, the upper ink containing chamber 370 and a lower ink containing chamber 390 into which a primary ink containing chamber filled with the ink I are divided, and the buffer chamber 430 which is positioned so as to be interposed therebetween are formed in the front surface of the cartridge body 10 (see FIG. 10).

Further, in the rear surface of the cartridge body 10, the air communicating passage 150 introducing air into the upper ink containing chamber 370, which is the ink containing chamber on the uppermost stream, with a consumption amount of the ink I.

The ink containing chambers 370 and 390 and the buffer chamber 430 are partitioned by a rib 10*a*. In the exemplary embodiment, in each ink containing chamber, recesses 374, 394, and 434 having a caved-in shape downward are formed in a part of the rib 10*a* that horizontally extend so as to form bottom walls of the ink containing chambers.

The recess 374 is formed in the manner that a part of a bottom wall 375 formed by the rib 10*a* of the upper ink containing chamber 370 is carved in downward. The recess 394 is formed in the manner that a bottom wall 395 formed by the rib 10*a* of the lower ink containing chamber 390 and a bulge of the wall surface are carved in a thickness-wise direction of the cartridge. The recess 434 is formed in the manner that a part of a bottom wall 435 formed by the rib 10*a* of the buffer chamber 430 is carved in downward.

Moreover, ink discharging ports 371, 311, and 432 that communicate with the ink guide passage 380, an upstream ink end sensor connecting passage 400, and an ink guide passage 440 are provided in bottom portions or the vicinity of the recesses 374, 394, and 434, respectively.

The ink discharging ports 371 and 432 are through-holes that pierce through the wall surface of each ink containing chamber in the thickness-wise direction of the cartridge body 10. In addition, the ink discharging port 311 is a through-hole that pierces through the bottom wall 395 downward.

One end of the ink guide passage 380 communicates with the ink discharging port 371 of the upper ink containing chamber 370 while the other end thereof communicates with an ink inflow port 391 provided in the lower ink containing chamber 390. In this way, the ink guide passage 380 serves as a communicating flow passage for guiding the ink I contained in the upper ink containing chamber 370 to the lower ink containing chamber 390. The ink guide passage 380 is provided to extend from the ink discharging port 371 of the upper ink containing chamber 370 vertically downward. Accordingly, the ink guide passage 380 allows the pair of the ink containing chambers 370 and 390 to be connected with each other so that the ink I descends from upstream side to downstream side.

One end of the ink guide passage 420 communicates with the ink discharging port 312 of the cavity of the ink residual quantity sensor 31 positioned on the downstream of the lower ink containing chamber 390 while the other end thereof communicates with an ink inflow port 431 provided in the buffer chamber 430. Accordingly, the ink guide passage 420 guides the ink I contained in the lower ink containing chamber 390 to the buffer chamber 430. The ink guide passage 420 is provided so as to extend obliquely upward from the ink discharging port 312 of the cavity in the ink residual quantity sensor 31. Accordingly, the ink guide passage 420 allows the pair of the ink containing chambers 390 and 430 to be connected with each other so that the ink I ascends from upstream side to downstream side. That is, in the cartridge body 10 according to the exemplary embodiment, the three ink containing chambers 370, 390, and 430 are allowed to be alternatively connected in series to each other so that the ink I descends or ascends.

The ink guide passage 440 serves as an ink flow passage that allows the ink discharging port 432 of the buffer chamber 430 to guide the ink to a differential valve 40.

In this exemplary embodiment, the ink inflow ports 391 and 431 of the ink containing chambers are provided so as to be positioned above the ink discharging port 371 and 311 provided in the ink containing chambers and in the vicinities of the bottom walls 375, 395, and 435 of the ink containing chambers.

First, the ink guide passage from the upper ink containing chamber 370, which is a primary ink containing chamber, to the ink supply portion 50 will be described below with reference to FIGS. 8 to 12.

The upper ink containing chamber 370 is an ink containing chamber on the uppermost stream (the uppermost portion) in the cartridge body 10. As shown in FIG. 8, the upper ink containing chamber 370 is formed on the front surface of the cartridge body 10. The upper ink containing chamber 370 occupies about the half of an ink contained area of the ink containing chambers and is formed above the substantial half of the cartridge body 10.

The ink discharging port 371 that communicates with the ink guide passage 380 opens in the recess 374 of the bottom wall 375 of the upper ink containing chamber 370. The ink discharging 371 is positioned below the bottom wall 375 of the upper ink containing chamber 370. Even when an ink level F in the upper ink containing chamber 370 decreases to the bottom wall 375, the ink discharging port 371 is positioned lower than the ink level F. Accordingly, the ink I continues to be stably discharged.

As shown in FIG. 9, the ink guide passage 380 that is formed on the rear surface of the cartridge body 10 allows the ink I to flow from the upper portion to the lower ink containing chamber 390.

The lower ink containing chamber 390 is an ink containing chamber into which the ink I stored in the upper ink containing chamber 370 is imported. Moreover, as shown in FIG. 8, the lower ink containing chamber 390 occupies about the half of the ink contained area of the ink containing chambers formed on the front surface of the cartridge body 10, and is formed below the substantial half of the cartridge body 10.

The ink inflow port 391 that communicates with the ink guide passage 380 opens to a communicating flow passage disposed below the bottom wall 395 of the lower ink containing chamber 390. Accordingly, the ink I flows from the upper ink containing chamber 370 through the communicating flow passage.

An ink discharging port 311 that pierces through the bottom wall 395 allows the lower ink containing chamber 390 to communicate with the upstream ink end sensor connecting passage 400. A three-dimensional labyrinthine flow passage is formed in the upstream ink end sensor connecting passage 400. Accordingly, bubble B or the like that flows to the labyrinthine flows passage before the ink ends are caught so as not to flow toward the downstream.

The upstream ink end sensor connecting passage 400 communicates with a downstream ink end sensor connecting passage 410 through an ink inlet portion 427 that is a through-hole. Moreover, the ink I is guided to flow to the ink residual quantity sensor 31 through the downstream ink end sensor connecting passage 410.

The ink I guided to flow to the ink residual quantity sensor 31 is guided to flow from the ink discharging port 312, which is an outlet port of the cavity, to the ink guide passage 420, which is formed on the rear surface of the cartridge body 10, through the cavity (flow passage) within the ink residual quantity sensor 31.

Since the ink guide passage 420 is formed obliquely upward from the ink residual quantity sensor 31 so as to allow the ink I to flow upward, the ink guide passage 420 is connected to the ink inflow port 431 that communicates with the buffer chamber 430. Accordingly, the ink I that comes out of the ink residual quantity sensor 31 is guided to flow into the buffer chamber 430 through the ink guide passage 420.

The buffer chamber 430 is a small room that is partitioned by the rib 10*a* between the upper ink containing chamber 370 and the lower ink containing chamber 390 and serves as a space for storing the ink immediately before the differential pressure valve 40. The buffer chamber 430 is formed so as to be opposite to the rear side of the differential pressure valve 40. Accordingly, the ink I flows to the differential pressure valve 40 through the ink guide passage 440 that communicates with the ink discharging port 432 formed in the recess 434 of the buffer chamber 430.

The ink I that flows to the differential pressure valve 40 is guided to flow to the downstream by the differential pressure valve 40, and then is guided to an outlet flow passage 450 through a through-hole 451. Since the outlet flow passage 450 communicates with the ink supply portion 50, the ink I is supplied to the ink jet printing apparatus through the ink supply needle 240 inserted into the ink supply portion 50.

A bubble trapping passage 713 for trapping the bubble B mixed in the ink I is provided in the upstream ink end sensor connecting passage 400 that is a part of the ink guide passage between the detection position of the ink residual sensor 31 and the lower ink containing chamber 390.

Figure 13:
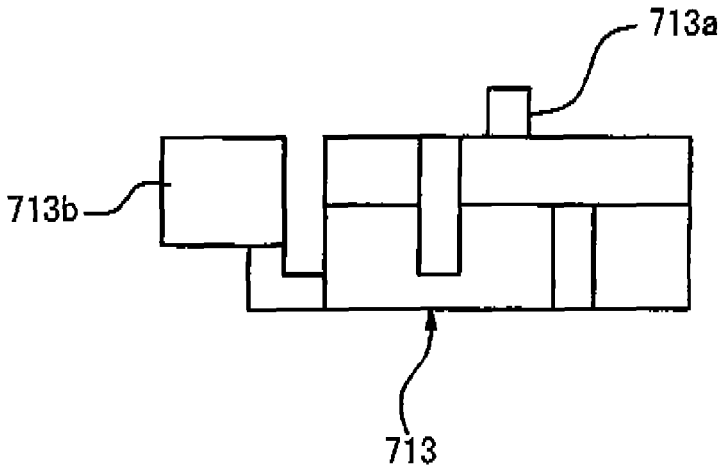
FIG. 13 is a side view illustrating the bubble trapping passage shown in FIG. 8.
Figure 14:
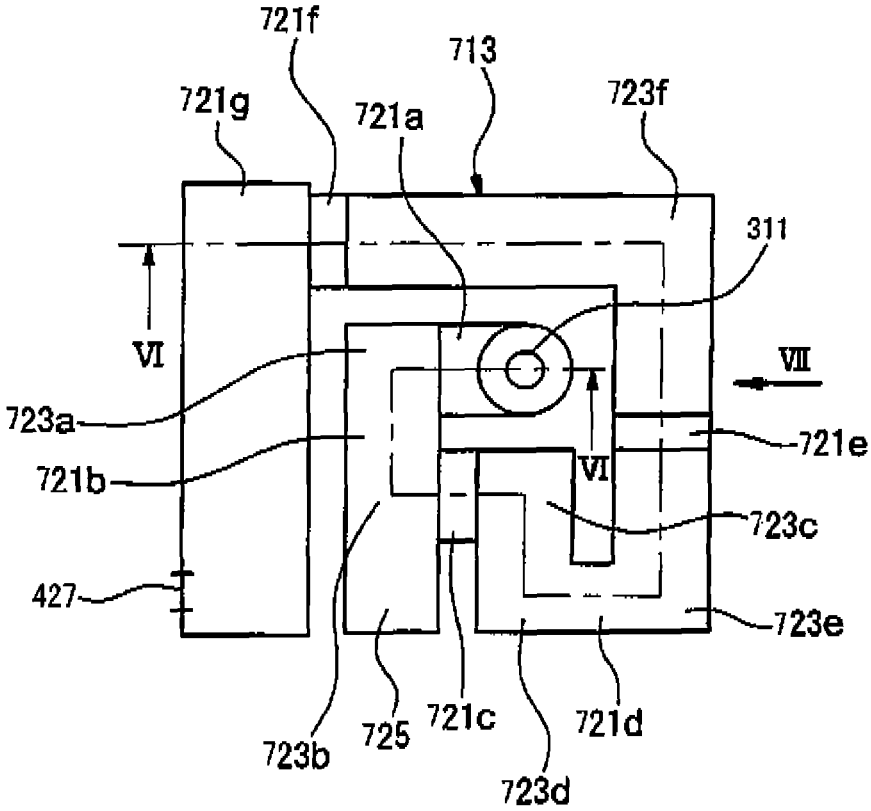
FIG. 14 is a top view illustrating the bubble trapping passage shown in FIG. 13.

As an overall configuration is shown in FIGS. 13 and 14, the bubble trapping passage 713 is substantially rectangular parallelepiped in shape so as to be inserted in the bottom portion of the container body 10.

As shown in FIG. 14, in the bubble trapping passage 713, an ink discharging port (inlet port) 311 into which the ink I flows from the lower ink containing chamber 390 is formed at the substantial center of the upper surface and an ink inlet portion (outlet port) 427 for discharging the ink I is formed on the outside of the sensor.

Figure 15:
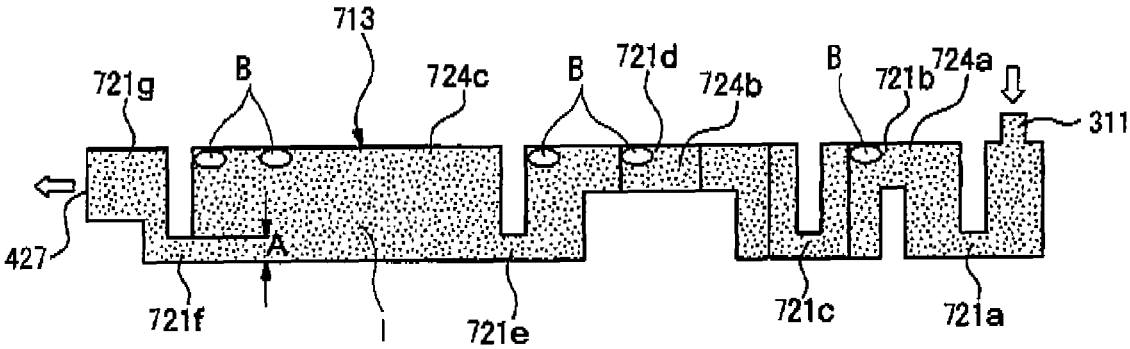
FIG. 15 is a sectional view illustrating the bubble trapping passage taken along the line VI-VI shown in FIG. 14.
Figure 16:
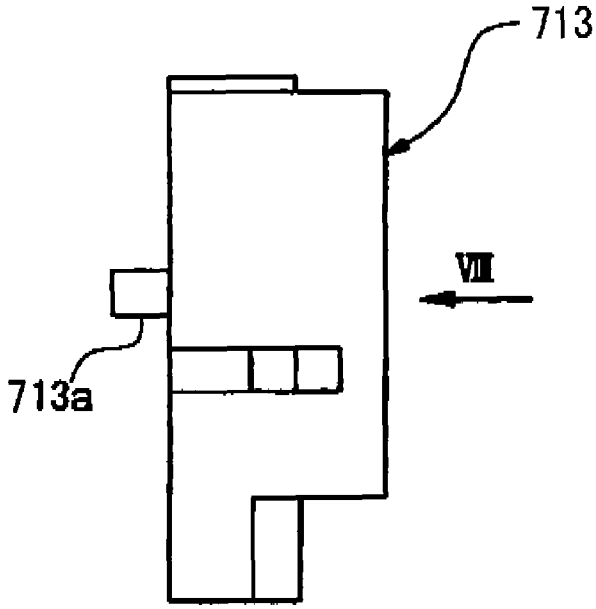
FIG. 16 is a perspective view illustrating the bubble trapping passage when viewed from the line VII of FIG. 14.

As shown in FIGS. 14 and 15, since a plurality of vertical changing portions 721*a* to 721*g* for changing a flow direction of the ink I to a vertical direction so as to reversely flow and a plurality of horizontal changing portions 723*a* to 723*f* for changing the flow direction of the ink I to a horizontal direction so as to flow at a right angle are combined, the bubble trapping passage 713 has a complex configuration with many bent portions.

In the bubble trapping passage 713, bubble trapping spaces 724*a* to 724*c* in which the section of the passage extends vertically upward more than a reference position A (see FIG. 15) of the section of the passage, which is the front and rear positions of the flow passage used for the end of the outlet port of the bubble trapping passage 713, are formed in several positions of the flow passages.

In the example shown in FIG. 15, the bubble trapping space 724*c* positioned in the most downstream has a largest capacity among the bubble trapping spaces 724*a* to 724*c*.

A bubble trapping space 725 is formed at the end of the bubble trapping passage 713 according to this exemplary embodiment.

The ink discharging port 311 connected to the bubble trapping passage 713 is formed in the circular-section passage with a 2 mm or less diameter. In this exemplary embodiment, the bubble trapping passage 713 is positioned in the end of the lower ink containing chamber 390 of the upstream ink end sensor connecting passage 400. In addition, the ink discharging port 311 that serves as the inlet port of the bubble trapping passage 713 also serves as an ink supply port (liquid supply port) from the lower ink containing chamber 390 to the upstream ink end sensor connecting passage 400.

In this exemplary embodiment, the bubble trapping passage 713 is formed by means of resin injection molding, and each flow passage constituting the bubble trapping passage 713 is formed in a rectangular sectional shape.

In the above-described ink cartridge 1, the air in the ink containing chamber may be mixed due to vibration or the like at a conveyance time after manufacture or the bubble B may be mixed in the ink I when the ink cartridge 1 is stirred at a using time or a temperature varies. However, when the ink passes through the bubble trapping passage 713 provided in the more upstream side than the detection position of the ink residual quantity sensor 31 provided in the upstream ink end sensor connecting passage 400, the ink I filled in the bubble trapping passage 713 induces buoyancy acting against the inflow to the downstream side to act on the bubble B floating in the ink I that flows into the upstream ink end sensor connecting passage 400 from the lower ink containing chamber 390 to the ink supply portion 50. For this reason, the bubble B is separated form the ink I to be trapped (see FIG. 15). Accordingly, the bubble B cannot flow to the ink residual sensor 31.

Moreover, the bubble B mixed in the ink I of the lower ink containing chamber 390 is not stuck to the ink residual quantity sensor 31 provided at the vicinity of the ink supply portion 50. In addition, the liquid residual quantity detector of the ink jet printing apparatus does not erroneously detect that the amount of residual ink of the lower ink containing chamber 390 is zero or decreases to a predetermined amount, and moreover can exactly detect that the amount of the residual ink of the lower ink containing chamber 390 is zero or decreases to a predetermined amount (so called, near end).

In the ink cartridge 1 according to the exemplary embodiment, since a plurality of vertical changing portions 721*a* to 721*g* for changing the flow direction of the ink to a vertical direction and a plurality of horizontal changing portions 723*a* to 723*f* for changing the flow direction of the ink to a horizontal direction are combined with each other, the bubble trapping passage 713 has a three-dimensional configuration and a complex flow passage configuration in order to save a small space. In addition, each changing portion serves as separating the bubble B from the ink I. In this way, the ink I flowing to the ink supply portion 50 goes through the bubble B-tapping process until the ink I reaches the ink residual quantity detector 31. As a result, since the mixed bubble B is completely removed from the ink I, it is possible to reliably prevent the bubble B mixed in the ink I stuck to the ink residual quantity sensor 31 from causing the erroneous detection.

In the ink cartridge 1 according to the exemplary embodiment, the bubble B separated from the ink I in the changing portions 721*g* to 721*g* and 723*a* to 723*f* is stored in the bubble trapping spaces 724*a* to 724*c* in which the section of the passages extend vertically upward more than the front and rear positions of the passage, or at the ends of the bubble trapping spaces 725*a* and 725*b*. Further, a large amount of bubble B can be stored in the bubble trapping spaces 724*a* to 724*c*, 725*a*, and 725*b*. As a result, missing trapping the bubble B due to a capacity shortage of the bubble trapping space can be suppressed.

The ink I filled in the bubble trapping spaces induces the buoyancy acting against the downward inflow to act on the air stored in the bubble trapping spaces 724*a* to 724*c* since the front and rear of the flow passage is positioned below the bubble trapping spaces. For this reason, even when the ink cartridge 1 separated from an apparatus during the usage is affected by a strong vibration or an impact due to falling or the like, it is difficult for the air stored in the bubble trapping spaces to leak out of the bubble trapping spaces. Moreover, a large amount of the bubble B can be stored in one bubble trapping space.

Even though the air stored in one bubble trapping space might leak to the adjacent flow passages due to a vibration or an impact of the ink cartridge 1, the leaking air is re-trapped or re-stored by the vertical changing portions positioned downstream or the ends of the bubble trapping spaces. As a result, the leaking air does not reach the ink residual quantity sensor 31.

Accordingly, even when the ink cartridge 1 separated from an apparatus during the usage is affected by a strong vibration or an impact due to falling or the like, the bubble B mixed in the ink I of the lower ink containing chamber 390 is not stuck to the ink residual quantity sensor 31 provided at the vicinity of the ink supply portion 50. Moreover, the liquid residual quantity detector of the ink jet printing apparatus can reliably detect that the amount of the residual ink of the lower ink containing chamber 390 is zero or lowered to a predetermined amount without erroneous detection.

In the ink cartridge 1 according to the exemplary embodiment, the ink discharging port (inlet of the bubble trapping passage 713) 311 that serves as an ink outlet is formed of the circular-section passage with 2 mm or less diameter. Accordingly, since the ink discharging port 311 forms meniscus for preventing the bubble B from leaking, the bubble B can be prevented from leaking from the lower ink containing chamber 390 to the ink residual quantity sensor 31. Moreover, since a burden on trapping the bubble in the bubble trapping passage 713 can be reduced, it can be improved that the bubble B is prevented from being stuck to the ink residual quantity sensor 31.

Since the ink cartridge 1 according to the exemplary embodiment has a rectangular section passage, an unnecessary space between the parallel flow passages exists less than the flow passage with the circular-section passage, and thus the highly complex flow passages can be formed. Even when the bubble trapping passage 713 is formed by means of resin molding, moldability is improved.

In addition, when the section of the passage is rectangular, comparing to the circular-section passage, sluggish areas in which the ink slowly flows at corners of the rectangular section passage are formed. Since the upper corners of the rectangular section passage also serve as the bubble trapping space in which the bubbles separated in the flow changing portions are stored, it is easy to capture or trap the bubble B.

A porous member that traps the bubble B may be provided in the bubble trapping passage 713 or in the ink guide passage that is in the more upstream side than the detection detected by the ink residual quantity sensor 31.

Then, since minute holes effectively trap the bubbles mixed in the ink in the porous member provided in the flow passage, it can be improved that the bubbles are trapped efficiently and reliably.

In this way, the ink cartridge 1 has a configuration in which the flow passage is changed in a various directions and the bubble B can be captured or trapped in the various directions. Accordingly, even when the ink cartridge 1 is postured arbitrarily, it is possible to prevent the bubble B from reaching the ink residual quantity sensor 31. A high precision detection of the ink end is guaranteed and it is possible to prevent the ink cartridge 1 still containing the ink I from being replaced.

Next, the air communicating passage 150 from the air introducing hole 100 to the upper ink containing chamber 370 will be described with reference to FIGS. 8 to 12.

When an inner pressure of the ink cartridge 1 is reduced with a consumption of the ink I contained in the ink cartridge 1, air (gas) flows from the air introducing hole 100 to the upper ink containing chamber 370 as much as a reduction amount of the stored ink I.

A small hole 102 that is provided in the air introducing hole 100 communicates with an one end of a meandering passage 310 formed on the rear surface of the cartridge body 10. The meandering passage 310 is a meandering passage that is formed lengthwise, and extends from the air introducing hole 100 to the upper ink containing chamber 370 to prevent moisture of ink from evaporating. Further, the other end thereof is connected to the gas-liquid separating filter 70.

A through-hole 322 is formed on a bottom surface of the gas-liquid separating chamber 70*a* that constitutes the gas-liquid separating filter 70, and communicates with a space 320 formed on the front surface of the cartridge body 10 through the through-hole 322.

In the gas-liquid separating filter 70, the gas-liquid separating film 71 is disposed between the through-hole 322 and the other end of the meandering passage 310. The gas-liquid separating film 71 has a meshed shape and is made of a textile material that has a high water repellent property and high oil repellent property.

The space 320 is formed on the right upper portion of the upper ink containing chamber 370 when viewed from the front surface of the cartridge body 10. In the space 320, a through-hole 321 opens above the through-hole 322. The space 320 communicates with an upper connection flow passage 330 formed on the rear surface through the through-hole 321.

The upper connection flow passage 330 has partial flow passages 333 and 337. The partial flow passage 333 extends from the through-hole 321 along the long side in the right direction, when viewed from the rear surface so as to pass through the uppermost surface of the ink cartridge 1, that is, the uppermost portion from the gravity direction in a state where the ink cartridge 1 is mounted. The partial flow passage 337 reverses in a reverse portion 335 at the vicinity of the short side, passes through the upper surface of the ink cartridge 1, and extends up to a through-hole 341 formed at the vicinity of the through-hole 321. Further, the through-hole 341 communicates with the ink trap chamber 340 formed on the front surface.

When the upper connection flow passage 330 is viewed from the rear surface, a position 336 in which the through-hole 341 is formed and a concave portion 332 which is carved more deeply than the position 336 in the thickness-wise direction of the ink cartridge are provided in the partial flow passage 337 that extends from the reverse portion 335 to the through-hole 341. A plurality of ribs 331 are formed so that the concave portion 332 is partitioned. The partial flow passage 333 that extends from the through-hole 321 to the reverse portion 335 is formed so as to be shallower the partial flow passage 337 that extends the reverse portion 335 to the through-hole 341.

In the exemplary embodiment, since the upper connection flow passage 330 is formed in the uppermost portion from the gravity direction, the ink I does not normally flow to the air introducing hole 100 beyond the upper connection flow passage 330. Moreover, the upper connection flow passage 330 has as a sufficiently wide thickness much as the ink I does not flow backward by the capillary phenomenon, and the concave portion 332 is formed in the partial flow passage 337. Accordingly, it is easy to catch the ink I that flows backward.

The ink trap chamber 340 is a rectangular parallelepiped space that is formed in a corner of the right upper portion of the cartridge body 10 when viewed from the front surface. As shown in FIG. 12, the through-hole 341 opens to the vicinity of an inner corner of the left upper portion of the ink trap chamber 340 when viewed from the front surface. Further, in a front corner of the right lower portion of the ink trap chamber 340, a notch 342 is formed in the manner that a part of the rib 10*a*, which serves as a wall, is notched. Accordingly, the ink trap chamber 340 communicates with the connecting buffer chamber 350 through the notch 342.

The ink trap chamber 340 and the connecting buffer chamber 350 are air chambers that are provided so as to expand a capacity of the way of the air communicating passage 150. Even when the ink I flows backward from the upper ink containing chamber 370 due to some reason, the ink trap chamber 340 and the connecting buffer chamber 350 are configured to stay the ink I so that the ink I does not flow into the air introducing hole 100 any more. The specific role of the ink trap chamber 340 and the connecting buffer chamber 350 will be described below.

The connecting buffer chamber 350 is a space that is formed below the ink trap chamber 340. A depressurization hole 110 for extracting air when ink is injected is provided on the bottom surface 352 of the connecting buffer chamber 350. The through-hole 351 opens in the thickness-wise direction in the vicinity of the bottom surface 352 and in the lower portion in the downmost gravity direction when mounted on the ink jet printing apparatus. Accordingly, through the through-hole 351, the connecting buffer chamber 350 communicates with a connecting flow passage 360 formed on the rear surface.

The connecting flow passage 360 extends in a middle upward direction when viewed from the rear surface, and communicates with the upper ink containing chamber 370 through a through-hole 372 that is in the downstream end of the air communicating passage 150 opening in the vicinity of the bottom wall of the upper ink containing chamber 370. The air communicating passage 150 according to the exemplary embodiment is constituted by constituents from the air introducing hole 100 to the connecting flow passage 360. In the connecting flow passage 360, a meniscus is as slimly formed much as the ink I does not flow backward.

In the ink cartridge 1 according to the exemplary embodiment, as shown in FIG. 8, the non-containing chamber 501 that does not contain the ink I is shown when viewed from the front surface of the cartridge body 10, in addition to the above-described ink containing chambers (the upper ink containing chamber 370, the lower ink containing chamber 390, and the buffer chamber 430), the air chambers (the ink trap chamber 340 and the connecting buffer chamber 350), and the ink guide passages (the upstream ink end sensor connecting passage 400 and the downstream ink end sensor connecting passage 410).

When viewed from the front surface of the cartridge body 10, the non-containing chamber 501 is partitioned in an area close to the hatched left surface so as to be inserted between the upper ink containing chamber 370 and the lower ink containing chamber 390.

In addition, in the non-containing chamber 501, an air introducing hole 502 that passes through the rear surface is provided at the left upper corner in the inner area thereof so as to communicate with open air through the air introducing hole 502.

When the ink cartridge 1 is depressurized and packed, the non-containing chamber 501 serves as a deaerating chamber in which a deaerating negative pressure is accumulated. Since an inner atmospheric pressure of the cartridge body 10 is maintained equal to or less than the prescribed value by a negative pressure suction force of the non-containing chamber 501 and the depressurized package, it is possible to supply the ink I that has dissolved air a little.

Next, when the ink I in the ink cartridge 1 described above is exhausted or is lowered to a predetermined amount, a method of injecting the ink I into the used ink cartridge 1 according to an exemplary embodiment will be described with reference to FIG. 17.

First, a configuration of an ink re-injecting apparatus used for the injecting method according to the exemplary embodiment will be described.

Figure 17:
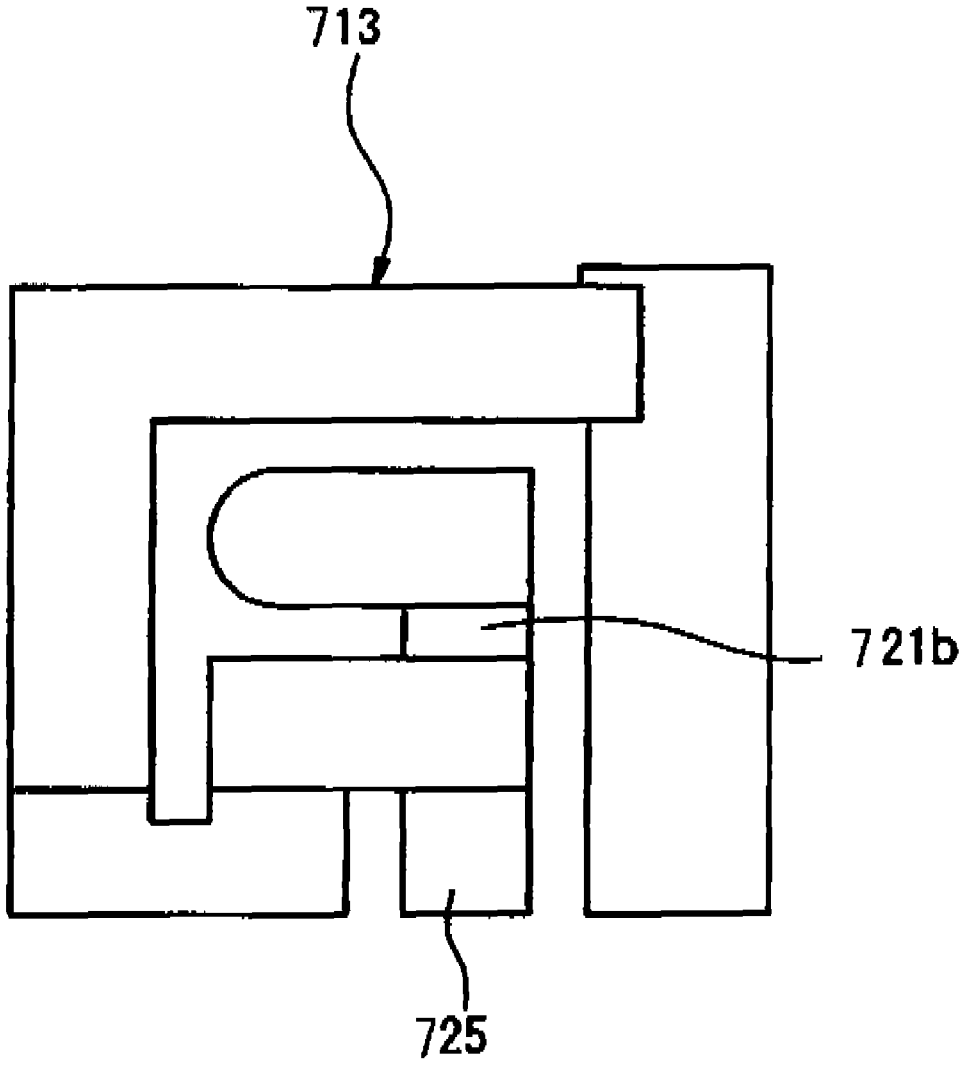
FIG. 17 is a perspective view illustrating the bubble trapping passage when viewed from the line VIII of FIG. 16.
Figure 18:
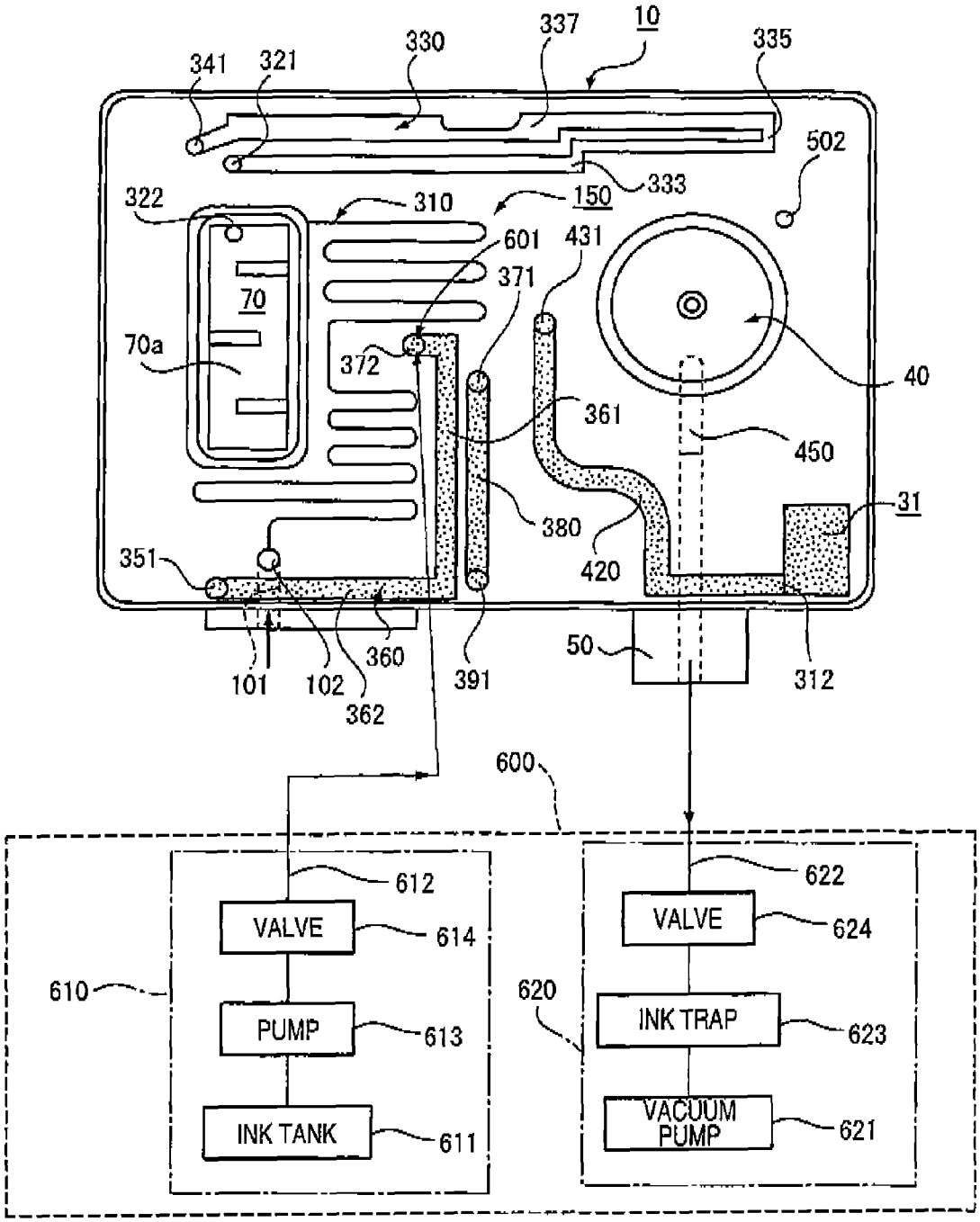
FIG. 18 is a block diagram illustrating a configuration of an ink re-injecting apparatus in which a method of injecting a liquid into an ink container according to the exemplary embodiment of the invention is performed.

As shown in FIG. 17, an ink re-injecting apparatus 600 includes an ink injecting mechanism 610 connected to an injection port 601, which is opened by a punching process in the ink cartridge 1, and a vacuum sucking mechanism 620 connected to the ink supply portion 50 of the cartridge body 10.

The ink injecting mechanism 610 includes an ink tank 611 for storing the filled ink I, a pump 613 for sending the ink I stored in the ink tank 611 to a flow passage 612 connected to the injection port 601, and a valve 614 for opening/closing the flow passage 612 between the pump 613 and the injection port 601.

The vacuum sucking mechanism 620 includes a vacuum pump 621 for generating a negative pressure required for the vacuum sucking; a connecting flow passage 622 for allowing the negative pressure generated by the vacuum pump 621 to apply to the ink supply portion 50; an ink trap 623 for being provided in the connecting flow passage 622, catching/collecting the ink I, which flows from the cartridge body 10 to the connecting flow passage 622 by the vacuum sucking, and protecting the vacuum pump 621 against ink mist or the like; and a valve 624 for opening/closing the connecting flow passage 622 between the ink trap 623 and the ink supply portion 50.

In the exemplary embodiment, in consideration of a configuration or a function of the ink cartridge 1, a position in which the injection port 601 communicating with the upper ink containing chamber 370 is formed in air communicating path 150 is determined in the vicinity of a position opposite to the through-hole 372 which is positioned in a downstream end of the connecting flow passage 360 constituting a part of the air communicating path 150.

The injection port 601 opposite to the through-hole 372 is bored through the outer surface film 60 (film member) covering the rear side surface of the cartridge body 10 to conform with the through-hole 372. In the front end portion of the flow passage 612 inserted into the injection port 601, for example, a sealing member or the like for air-tightly allowing the flow passage 612 to connect to the through-hole 372 is provided by tightly pressing against the through-hole 372 and attaching to the wall surface of the circumference of the through-hole 372.

The injection port 601 communicating with the upper ink containing chamber 370 is formed in the air communicating path 150 positioned on more upstream than the upper ink containing chamber 370. The position on which the injection port 601 is formed is not limited to the exemplary embodiment.

For example, the injection port 601 may be formed by boring a hole through the outer surface film 60 so as to conform with the connecting flow passage 360 constituting a part of the air communicating path 150, or by peeling off the outer surface film 60. Alternatively, the injection port 601 may be formed by peeling off the outer surface film 60 and the gas-liquid separating film 71 so as to conform with the through-hole 322 opening to the gas-liquid separating chamber 70*a* constituting the gas-liquid separating filter 70.

Moreover, the injection port 601 may be formed by removing the cover member 20 from the ink cartridge 1, exposing the film 80 covering the front side surface of the cartridge body 10, and boring a hole through the film 80 so as to conform with the through-hole 351 that is positioned in the upper end of the connecting flow passage 360 constituting a part of the air communicating path 150.

According to the exemplary embodiment, the used ink cartridge 1 is recovered as a reusable ink cartridge (liquid container) by, first, an injecting forming step of forming the injection port 601 communicating with the upper ink containing chamber 370 in the air communicating path 150, a vacuum sucking step of sucking and removing the residual ink and residual air remaining in the inside from the ink supply portion 50 by the vacuum sucking mechanism 620, a liquid injecting step of injecting a predetermined amount of ink from the injection port 601 by the ink injecting mechanism 610, and a sealing step of sealing the injection port 601 after the liquid injecting step.

Specifically, the sealing step is a process of forming a sealing portion. Specifically, the injection port 601 is air-tightly closed by attaching or welding a sealing film, a tape or the like, or by putting a stopper or the like.

In the above-described ink injecting method of the ink cartridge according to the exemplary embodiment, a process of injecting the ink I into the ink cartridge 1 is performed by the step of opening the injection port 601 for injecting the ink I to the outer surface film 60 so as to communicate with the upper ink containing chamber 370, and the step of sealing the injection port 601 after injecting the ink I, which are all the simple steps. As a result, a processing cost can be reduced and it is not difficult to re-fill an ink cartridge.

In the exemplary embodiment, the vacuum sucking step of sucking and removing the residual ink and residual air remaining in the inside from the ink supply portion 50 is provided. As a result, when the liquid injecting step of injecting the predetermined amount of the ink I from the injection port 601 is performed, the ink guide paths 380, 420, and 440 or the ink containing chambers of the cartridge body 10 are controlled under the depressurization environment, and thus all the ink guide paths including the ink supply portion 50 as well as the ink containing chambers 370, 390, and 430 can effectively refill with the injected ink I.

Bubbles that are mixed when the ink I is injected can be extracted from the ink supply portion 50 to the outside by means of the vacuum sucking, or inflow bubbles can be dissolved/disappeared in the liquid under the depressurization environment in the container formed by means of the vacuum sucking.

Moreover, the bubble B floating within the ink I, which flows into the upstream ink end sensor connecting passage 400 when the ink I is injected, passes through the bubble trapping passage 713 provided in the midway of the upstream ink end sensor connecting passage 400. At the time, buoyancy acts against the bubble B so as not to flow into the downstream due to the ink I filled with the bubble trapping passage 713. In the bubble trapping passage 713, the bubble B is separated from the ink I and caught (see, FIG. 15). Therefore, the bubble B rarely flows into a side of the ink residual quantity sensor 31. Accordingly, the erroneous detection due to sticking of the bubble B, which is mixed in the ink of the ink containing chambers 370, 390, and 430, to the ink residual quantity sensor 31 can be prevented.

When the refilled ink cartridge refilled by such an ink injecting method is provided, the expected life span of the product as an ink cartridge container is increased. As a result, the resource can be saved and the environmental pollution can be prevented. Further, since a cost required for the re-filling is inexpensive, and an ink cartridge is provide at a low price, a running cost for the ink jet printing apparatus can be reduced.

In addition, in the above-described ink injecting method of the ink cartridge according to the exemplary embodiment, a cleaning liquid can be injected in the cartridge body 10 from the injection port 601 to clean/remove coagulated ink in the inside of the container between the vacuum sucking step and the liquid injecting step. It is not required that the processing order of the vacuum sucking step and the liquid injecting step are definitely set. For example, while performing the vacuum sucking step, the liquid injecting step may be performed together.

The ink re-injecting apparatus 600 used to perform the ink injecting step according to the exemplary embodiment may be substituted by an apparatus that can be easily obtained.

For example, the ink injecting mechanism 610 may be substituted by an injecting apparatus constituted by a cylinder and a piston for a syringe, or may be substituted by a supplementary bottle containing supplementary ink in a deformable pet bottle.

In the liquid container according to the exemplary embodiment, the configuration of the container body, the liquid containing portion, the liquid supply portion, the liquid guide path, the air communicating path, the liquid detecting portion, the dam portion, and the like is not limited to the exemplary embodiment, but may be modified in various forms without departing from the gist of the invention.

A use of the liquid container according to the invention is not limited to the above-described ink cartridge of the ink jet printing apparatus. The liquid container can be applied to various liquid consuming apparatus including a liquid ejecting head ejecting a small amount of liquid drop, and the like.

Specific examples of the liquid consuming apparatus include an apparatus having a color material ejecting head used for manufacturing a color filter such as a liquid crystal display, an apparatus having an electrode material (conductive paste) ejecting head used for forming an electrode such as an organic EL display, or a field emission display (FED), an apparatus having a bioorganic matter ejecting head used for manufacturing a biochip, an apparatus having a simple ejecting head used for a precision pipette, a printing apparatus, a micro dispenser, and the like.

The entire disclosure of Japanese Patent Application Nos' 2006-220767 filed on Aug. 12, 2006, 2006-220755 filed on Aug. 11, 2006 and 2006-220770 filed on Aug. 12, 2006 are expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. A method of manufacturing a liquid container storing a liquid, the method comprising:

providing the liquid container which is detachably mounted on a liquid consuming apparatus, and which comprises a liquid containing portion, a liquid supply portion connectable to a liquid ejecting portion of the liquid consuming apparatus, a liquid guide passage for guiding the liquid stored in the liquid containing portion to the liquid supply portion, an air communicating passage supplying the liquid containing chamber with air, a liquid detection unit provided in the liquid guide passage and for outputting different signals between in a case where the liquid guide passage is filled with the liquid and in a case where the liquid guide passage includes air entered thereinto, and a bubble trapping passage provided in the liquid guide passage between a detection position of the liquid detection unit and the liquid containing portion to trap bubbles in the liquid;

boring a hole in order to form an injection port communicating with the liquid containing portion in the air communicating passage;

injecting such amount of the liquid that bubbles in the liquid passing through the bubble trapping passage can be trapped by the bubble trapping passage through the injection port; and sealing the injection port after injecting the liquid.

2. The method according to claim 1, further comprising depressurizing an inside of the liquid containing chamber before injecting the liquid.

3. The method according to claim 2, wherein the inside of the liquid containing chamber is depressurized through the liquid supply portion.

4. The method according to claim 1, wherein the injection port is formed in a downstream end of the air communicating path.

5. The method according to claim 1, wherein the bubble trapping passage includes a vertical changing portion which changes a flow direction of the liquid to a vertical direction so as to reversely flow.

6. A liquid container detachably mounted on a liquid consuming device includes:

a liquid containing portion;

a liquid supply portion connectable to the liquid consuming device;

a liquid guide passage communicating the liquid containing portion and the liquid supply portion with each other;

an air communicating path communicating the liquid containing portion with air;

a liquid detection unit provided in the liquid guide passage and for outputting different signals between in a case where the liquid guide passage is filled with the liquid and in a case where the liquid guide passage includes air entered thereinto;

a bubble trapping passage provided in the liquid guide passage between a detection position of the liquid detection unit and the liquid containing portion to trap bubbles in the liquid;

a film member forming at least a part of the air communication path;

an injection port communicated with the liquid containing portion and formed on the film member; and a sealing portion at which the injection port is sealed.

7. The liquid container according to claim 6, wherein the sealing portion is formed by a film or a tape.

8. The liquid container according to claim 6, wherein the bubble trapping passage includes a vertical changing portion which changes a flow direction of the liquid to a vertical direction so as to reversely flow.

9. A method of manufacturing a liquid container, the method comprising:

providing a liquid container including a container body detachably mounted on an apparatus, the container body comprising:

a liquid containing portion, a liquid supply portion connected to a liquid ejecting portion of the apparatus, a liquid guide passage for guiding liquid stored in the liquid containing portion to the liquid supply portion, an air communicating passage introducing air into the liquid containing portion from an outside with a consumption of the liquid in the liquid containing portion, a liquid detection unit provided in the liquid guide passage for detecting that the liquid in the liquid containing portion is exhausted by detecting an inflow of gas, and a bubble trapping passage provided in the liquid guide passage between a detection position of the liquid detection unit and the liquid containing portion to trap bubbles in the liquid;

boring a hole in order to form an injection port communicating with the liquid containing portion in the air communicating passage;

injecting such amount of the liquid with such an amount that bubbles in the liquid passing through the bubble trapping passage can be trapped by the bubble trapping passage through the injection port; and sealing the injection port after injecting the liquid.

10. The method according to claim 9, wherein the bubble trapping passage includes a vertical changing portion which changes a flow direction of the liquid to a vertical direction so as to reversely flow.

* * * * *